US006600999B2

(12) United States Patent
Clark et al.

(10) Patent No.: US 6,600,999 B2
(45) Date of Patent: Jul. 29, 2003

(54) HI-RAIL VEHICLE-BASED RAIL INSPECTION SYSTEM

(75) Inventors: Robin Clark, New Fairfield, CT (US); Jeffery L. Boyle, Brookfield, CT (US); Douglas T. Main, Jr., Newtown, CT (US); Brewster W. LaMacchia, Andover, MA (US)

(73) Assignee: Sperry Rail, Inc., Danbury, CT (US)

( * ) Notice: Subject to any disclaimer, the term of this patent is extended or adjusted under 35 U.S.C. 154(b) by 61 days.

(21) Appl. No.: 09/973,903

(22) Filed: Oct. 10, 2001

(65) Prior Publication Data

US 2002/0065610 A1 May 30, 2002

Related U.S. Application Data

(60) Provisional application No. 60/238,966, filed on Oct. 10, 2000.

(51) Int. Cl.[7] ..... B61K 9/10

(52) U.S. Cl. ..... 702/35; 702/185

(58) Field of Search ..... 73/146, 636, 602, 73/632; 324/217, 220; 702/39, 33, 182, 184, 35, 81, 83, 84; 104/94

(56) References Cited

U.S. PATENT DOCUMENTS

| | | | | |
|---|---|---|---|---|
| 2,900,596 A | | 8/1959 | Drake | |
| 2,925,552 A | | 2/1960 | Cowan et al. | |
| 3,593,122 A | | 7/1971 | Barton et al. | |
| 3,962,908 A | | 6/1976 | Joy | |
| 4,174,636 A | | 11/1979 | Pagano | |
| 4,310,796 A | | 1/1982 | Braithwaite et al. | |
| 4,429,576 A | | 2/1984 | Norris | |
| 4,447,777 A | | 5/1984 | Sharp et al. | |
| 4,468,966 A | * | 9/1984 | Bradshaw | 73/636 |
| 4,560,931 A | | 12/1985 | Marukami et al. | |
| 5,351,621 A | | 10/1994 | Tanaka et al. | |
| 5,386,727 A | | 2/1995 | Searle | |
| 5,419,196 A | | 5/1995 | Havira et al. | |
| 5,578,758 A | | 11/1996 | Havira et al. | |
| 5,777,891 A | | 7/1998 | Pagano et al. | |
| 5,956,664 A | * | 9/1999 | Bryan | 702/184 |
| 5,970,438 A | | 10/1999 | Clark et al. | |
| 5,987,979 A | * | 11/1999 | Bryan | 73/146 |
| 6,044,698 A | * | 4/2000 | Bryan | 73/146 |
| 6,055,862 A | | 5/2000 | Martens | |
| 6,064,428 A | * | 5/2000 | Trosino et al. | 348/128 |
| 6,356,299 B1 | * | 3/2002 | Trosino et al. | 348/128 |

* cited by examiner

*Primary Examiner*—John Barlow
*Assistant Examiner*—Douglas N Washburn
(74) *Attorney, Agent, or Firm*—Hunton & Williams

(57) ABSTRACT

A railroad rail inspection system is provided for use in conjunction with a non-railbound vehicle having an equipment bay. The system comprises a detector carriage adapted for being propelled over a two-rail railroad track by the non-railbound vehicle. A magnetic induction sensor system adapted for magnetic induction inspection of at least one rail of the track is attached to the detector carriage. The system further comprises a data acquisition system in communication with the magnetic induction sensor system, the data acquisition system including at least one data processor adapted for processing induction data received from the magnetic induction sensor system. The system further comprises a power supply system adapted for supplying electrical power to the magnetic induction sensor system. The data acquisition system and the power supply system are configured for disposition and operation within the equipment bay of the non-railbound vehicle.

30 Claims, 17 Drawing Sheets

HI-RAIL VEHICLE-BASED RAIL INSPECTION SYSTEM

The present application derives priority from U.S. application No. 60/238,966, filed Oct. 10, 2000, which is incorporated herein by reference in its entirety.

FIELD OF THE INVENTION

The present invention relates broadly to non-destructive testing of steel rails and, more particularly, to a rail inspection system having a magnetic induction sensor system that can be used by a test vehicle that can be configured for either highway or railroad use.

BACKGROUND OF THE INVENTION

Basic Rail Testing Approaches

In the wake of several train derailments in the 1920's, it was determined that nondestructive testing methods for locating structural flaws in railroad rail was needed. Initial work focused on an approach wherein a current was applied to the rail and the drop in voltage used to determine the presence of a discontinuity within the rail. This voltage drop technique, although successful statically, proved to be unreliable when testing was carried out using a test car moving over the rails being tested. Subsequent research focused on magnetic induction techniques.

Induction testing is based on simple physical principles. A large direct current is injected into the rail using two sets of contacts or brushes as shown in FIG. 1. Discontinuities in the railhead section cause a disturbance of the current flowing through the railhead between the contacts. The discontinuity is detected using a sensing head that responds to the accompanying magnetic field disturbance. Perturbations in the magnetic field around the railhead are detected as induced voltages in search coils in the sensing head.

Magnetic induction was the dominant rail inspection technique until the introduction of ultrasonic techniques. Initially seen as complementing magnetic induction, ultrasonics later became the dominant technique. In the typical ultrasonic inspection unit, ultrasonic transducers are installed in pliable wheels that ride over the upper surface of the rail. The pliable wheels are filled with a coupling fluid and are in contact with the rails under pressure. The transducers are arranged to send ultrasonic signals at different angles into the rail and especially the railhead. The return signals are processed and used to map the locations of flaws in the rail.

Types of Rail Defects

Rail defects can occur in the rail head, web or base. Defects are usually a result of impurities in the original ingot that were elongated during the forging process. Depending on the nature of the impurity, the resulting flaw can grow along the axis of the rail or transverse to this axis. Transverse defects may also result from service-induced anomalies, such as work hardening of the railhead. Some of the more common defect classifications are as follows:

Transverse Fissure. This type of defect is usually centrally located in the railhead and results from an oxide inclusion or other small impurity that causes a "stress riser" in the rail. See FIG. 2. Growth of the inclusion flaw is promoted by the constant flexing of the rail. This growth generally continues until the rail eventually fractures. A fracture of this type exhibits "growth rings" as shown in FIG. 2.

Detail Fracture. This type of transverse defect usually occurs as a result of the work hardening of the railhead. This causes a split in the railhead and a transverse separation that typically begins on the gage side of the rail as shown in FIG. 3. (The "gage side" is defined as the side of the rail along which rail car wheel flanges run.) Another mechanism for this type of rail failure is an anomaly known as a "shell." A shell is usually caused by a horizontally oriented, axial, linear impurity (a "stringer") that becomes elongated and flattened during use. A shell is not usually classified as a defect in itself; however, it is common for such a condition to subsequently result in a transverse defect.

Vertical Split Head. A railhead stringer that is vertically oriented can grow in the vertical plane along the axis of the rail. This is referred to as a vertical split head and is potentially an extremely serious type of defect as it can result in the loss of the running surface of the rail. See FIG. 4. A horizontal split head usually originates from a longitudinal seam or inclusion. Growth usually occurs rapidly along the length of the inclusion and spreads horizontally as shown in FIG. 5.

Head and Web Separation. This type of defect is usually found at the end of the rail (i.e., at a joint). Such separation is believed to occur due to eccentric loading at the end of the rail. The separation occurs at the weakest point, which is where the railhead joins the web at the fillet. FIG. 6 shows a head and web defect that has progressed into the fillet area.

Bolt Hole Cracks. These defects are usually as the result of stresses applied to the edge of a bolt hole by the bolt. Such stresses are produced due to the cycling up and down of the joint as a train passes over it. The effect may be worsened by worn joint bars or improper drilling. A severe case is shown in FIG. 7.

Engine Burn Fractures. These defects result from wheel slippage during acceleration of a locomotive from a standstill. Rapid heating and cooling causes thermal cracks that are exacerbated by the train wheels pounding the area. Transverse separation can occur as a result. An example is shown in FIG. 8.

Defective Welds. Weld defects vary according to the weld type. In general, there are welds that are made during rail manufacture and there are welds that are made on site while the rail is being installed or repaired. Manufacturing welds are usually "flash butt" welds. Welds made in the field are mostly "thermite" welds. Defects that are germane to the flash butt type of weld are for the most part fusion type flaws. Thermite welding is actually a type of casting operation where a mold is situated around the profile of the rail and molten metal is allowed to flow between the mating surfaces. The flaw possibilities from a thermite weld can be more diverse, ranging from lack of fusion to porosity or other non-metallic inclusions.

Statistically, defects and associated failures can be broken down as follows:

| Type of Defect | Percentage of Defected Defects |
|---|---|
| Defective Welds | 22% |
| Bolt Hold Defects | 19% |
| Transverse Defects | 18% |
| Vertical Split Heads | 9% |
| Head and Web Separation | 7% |
| Detail Fractures | 6% |

-continued

| Type of Defect | |
|---|---|
| Engine Burn Fractures | 6% |
| | Percentage of Notified Failures |
| Transverse Defects | 33% |
| Defective Wells | 30% |
| Bolt Hole Defects | 9% |
| Vertical Split Heads | 8% |
| Detail Fractures | 4% |

Factors in Flaw Detection

Defect detection in railroad rails is complicated by the fact that rails come in a variety of shapes and sizes. The accessible scanning surface, which is usually the railhead, is extremely non-uniform. In addition to variability of the rail as manufactured, head shape changes over time as a result of use by high speed, high axle-load trains. The resulting non-uniformity of the rail geometry renders it difficult to maintain the contact of sensor equipment with the rail head. The difficulty is exacerbated by curves, crossings and switches. In addition to affecting data, these track components can be hazardous to the sensor equipment that contacts the rail.

The surface condition of the railhead can be an important limitation on sensor sensitivity. A railhead having rust, grease or other foreign matter such as leaves on its surface can severely inhibit the transfer of energy from an ultrasonic transducer mounted within a rail search unit tire. Search unit tires may also be punctured by steel slivers that develop on the railhead surface.

Weather can be a significant factor in flaw propagation. Contraction of the rail due to cold temperatures combined with heavy train axle loads are very conducive to flaw separation, particularly when a train has a flat spot on a wheel that happens to contact the rail at a critical location relative to the flaw. Weather can also have a significant impact on flaw detection. Formation of ice in particular can make testing extremely difficult.

Regardless of the system quality or its ability to detect defects, personnel and their training are an integral part of the equation. Experience has shown that proper personnel selection, combined with a good training and certification program usually leads to well qualified personnel in the field. Experienced personnel are able to add to the effectiveness of the system through their ability to note anomalies by simply watching the track as it is tested.

SUMMARY OF THE INVENTION

Not all rail defects are detectable by either the magnetic induction technique or the ultrasonic technique. Using a combination of the two methods greatly reduces the number of "false calls" (i.e., indications of a defect where such an indication is actually unwarranted).

Accordingly, it is highly desirable to conduct defect testing using both magnetic induction and ultrasonics as complementary methods. Heretofore, this has required a large rail-bound test vehicle that houses both ultrasonic and magnetic induction equipment and its associated data acquisition and processing equipment. Hi-rail inspection vehicles currently use only ultrasonic detection systems because, heretofore, the equipment required to generate the power for magnetic induction testing has been too large for such a vehicle. The railroads have therefore been prevented from taking full advantage of combined ultrasonic and induction testing.

An embodiment of the present invention accordingly provides a railroad rail inspection system for use in conjunction with a non-railbound vehicle having an equipment bay. The system comprises a detector carriage adapted for being propelled over a two-rail railroad track by the non-railbound vehicle. A magnetic induction sensor system is attached to the detector carriage. The magnetic inductor sensor system is adapted for magnetic induction inspection of at least one rail of the track. The system further comprises a data acquisition system in communication with the magnetic induction sensor system. The data acquisition system includes at least one data processor adapted for processing induction data received from the magnetic induction sensor system. The system still further comprises a power supply system in electrical communication with the magnetic induction sensor system. The power supply system is adapted for supplying electrical power to the magnetic induction sensor system. The data acquisition system and the power supply system are configured for disposition and operation within the equipment bay of the non-railbound vehicle.

Another aspect of the invention provides a railroad rail inspection system for use in conjunction with a non-railbound vehicle having an equipment bay in which the system comprises a detector carriage adapted for being propelled over a two-rail railroad track by the non-railbound vehicle. The system further comprises means for performing magnetic induction inspection of at least one rail of the track, the means for performing magnetic induction inspection being attached to the detector carriage. The system further comprises means for processing induction data received from the means for performing magnetic induction inspection and means for supplying electrical power to the means for performing magnetic induction inspection. The means for supplying electrical power includes means for generating power sufficient to establish a magnetic field around the rail for use by the means for performing magnetic induction inspection. The means for processing induction data and the means for supplying electrical power are configured for disposition and operation within the equipment bay of the non-railbound vehicle.

DETAILED DESCRIPTION OF THE INVENTION

The present invention provides a rail inspection system that includes a magnetic induction test apparatus mounted on a rail-traveling carriage propelled by a non-railbound vehicle such as a hi-rail vehicle.

Figure 1:
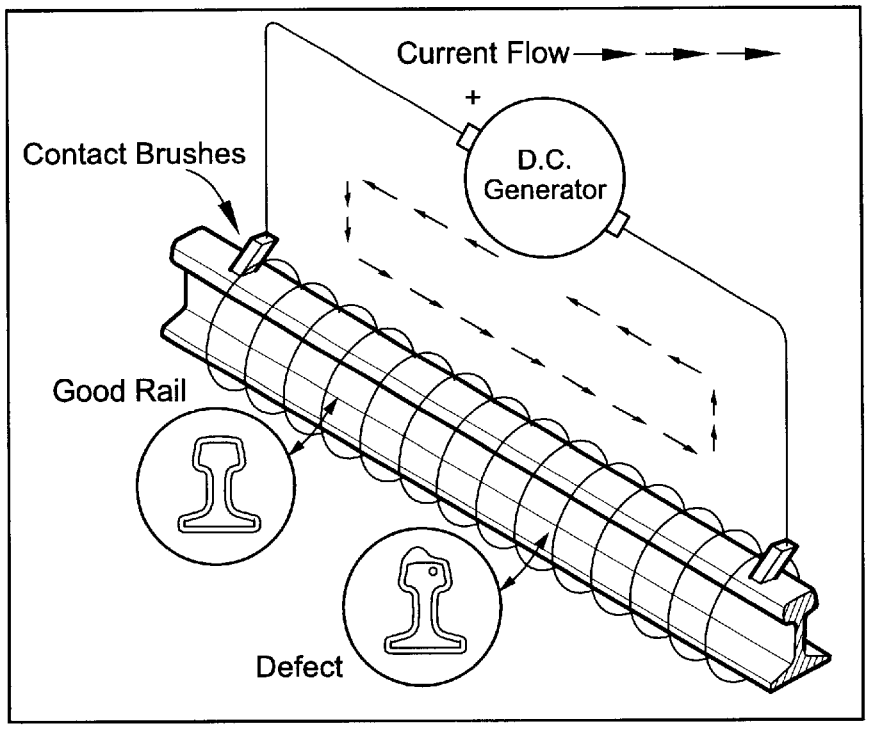
FIG. 1 is an illustration of magnetic induction test concepts.
Figure 2:
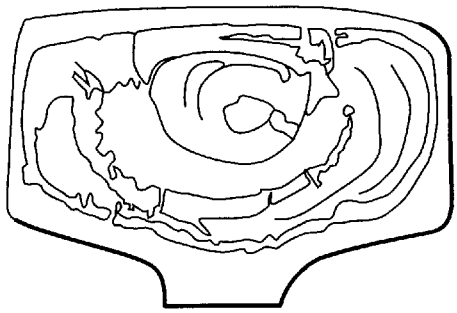
FIG. 2 is an illustration of the fractured surface of a rail with a defect of the transverse fissure type.
Figure 3:
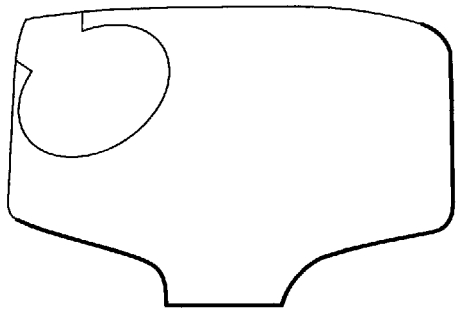
FIG. 3 is an illustration of a rail defect of the detail fracture type.
Figure 4:
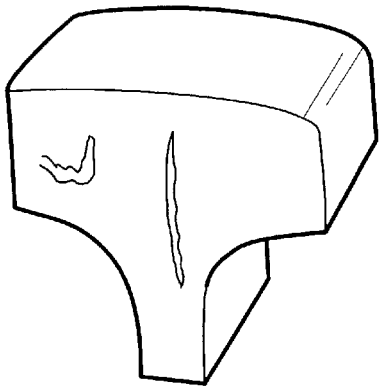
FIG. 4 is an illustration of a rail defect of the vertical split head type.
Figure 5:
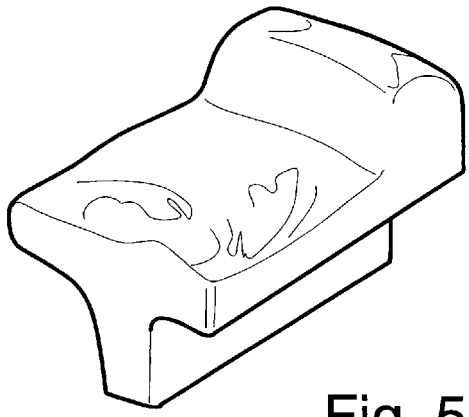
FIG. 5 is an illustration of the fractured surface of rail with a defect of the horizontal split head type.
Figure 6:
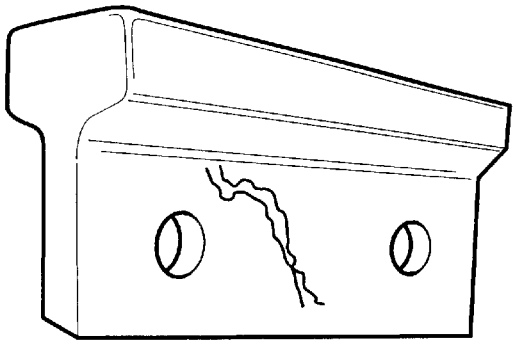
FIG. 6 is an illustration of a rail defect of the head and web separation type.
Figure 7:
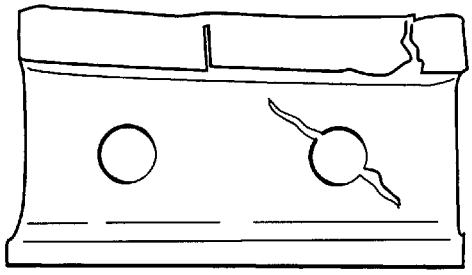
FIG. 7 is an illustration of a rail defect of the bolt hole type.
Figure 8:
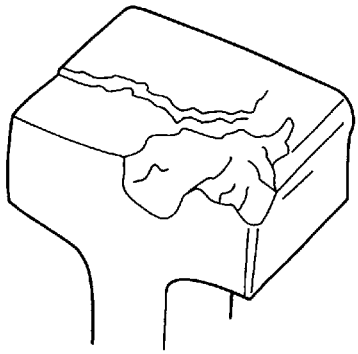
FIG. 8 is an illustration of engine bum fractures of a rail head.
Figure 9:
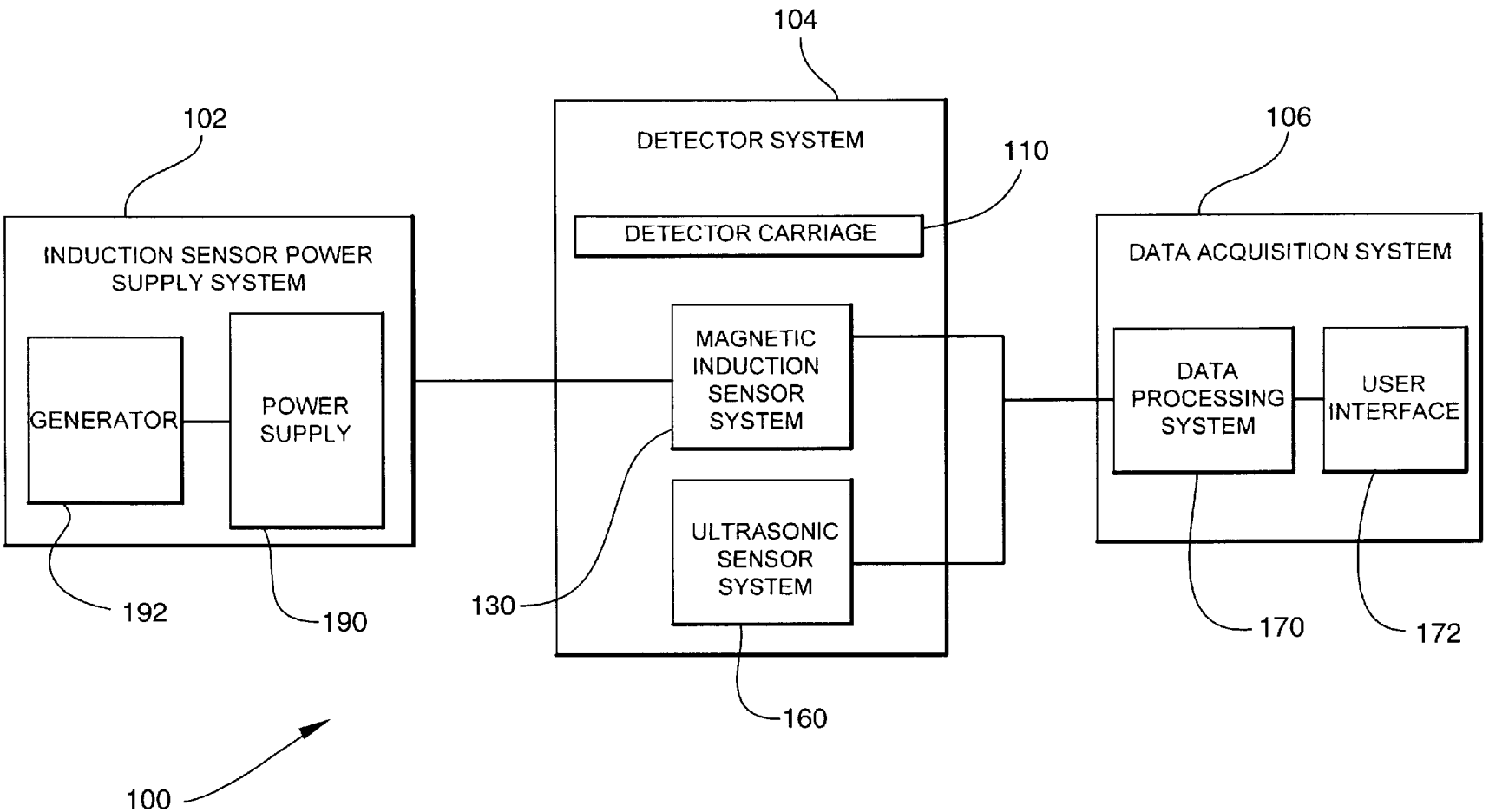
FIG. 9 is a schematic illustration of a rail inspection system according to an embodiment of the invention.

FIG. 9 provides a schematic illustration of a rail inspection system 100 according to the present invention. The inspection system 100 comprises a detector system 104 that includes a detector carriage 110 that may be towed or otherwise propelled over a two rail track by a vehicle. The detector carriage 110 carries a magnetic induction sensor system 130 and may also carry an ultrasonic sensor system 160. The rail inspection system 100 also includes an induction sensor power supply system 102 in electrical communication with the magnetic induction sensor system 130. The induction sensor power supply system 102 includes a generator 192 and one or more power supplies 190 that provide power to the magnetic induction sensor system 130 for use in electrifying a portion of a rail for induction inspection thereof. The rail inspection system 100 also includes a data acquisition system 106 in communication with the induction sensor system 130 and the ultrasonic sensor system 160. The data acquisition system 106 includes a data processing system 170 and a user interface 172 usable by an operator to control the inspection system 100 and to receive inspection data therefrom.

Figure 10:
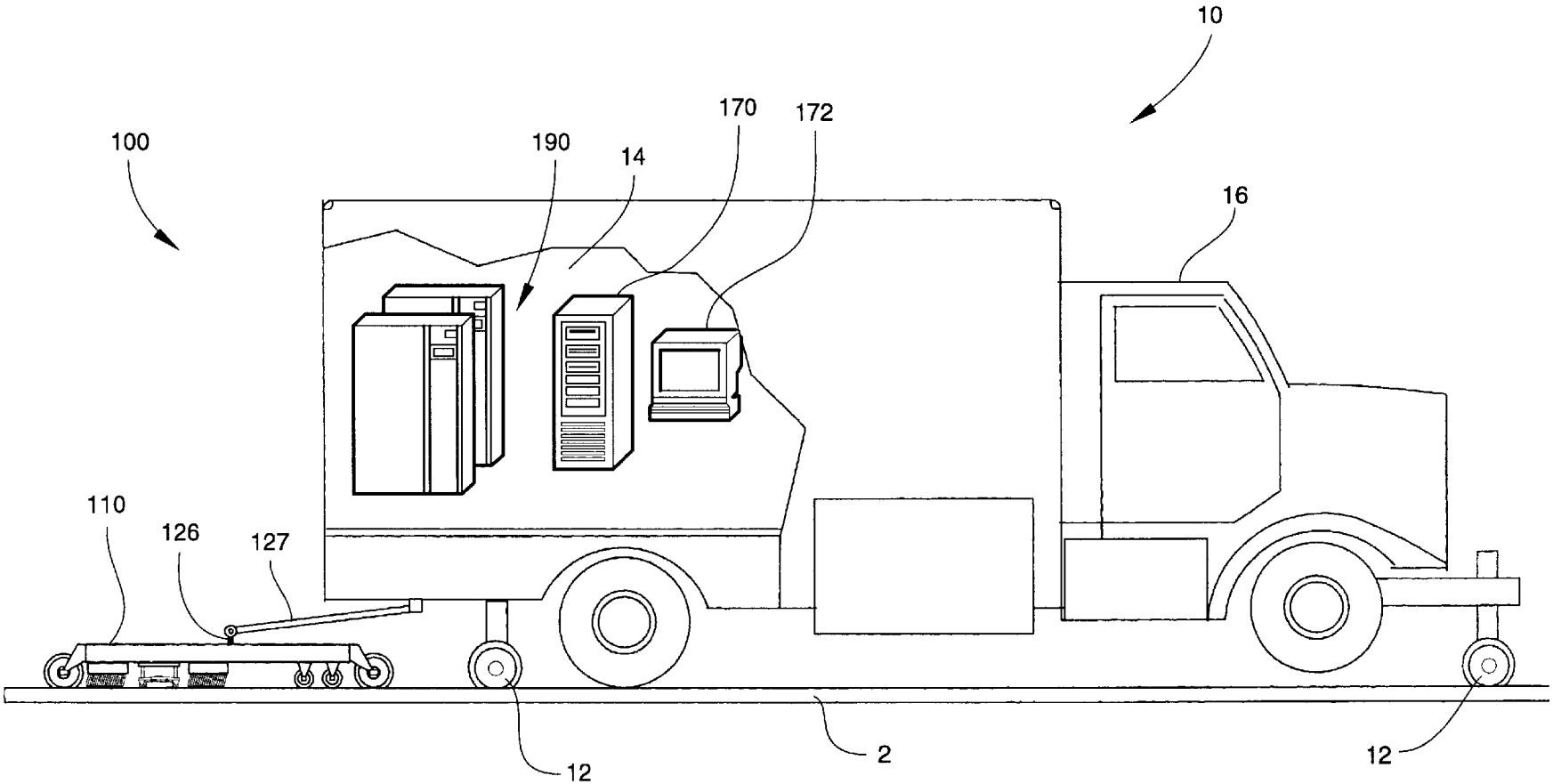
FIG. 10 is a side view of a rail inspection system according to an embodiment of the invention.

FIG. 10 illustrates a rail inspection system 100 that is configured for use in conjunction with a hi-rail vehicle 10. As used herein, the term "hi-rail vehicle" (or "high-rail vehicle") means a conventional highway vehicle modified to include front and rear wheels 12 that can be extended to allow the vehicle to travel over railroad rails 2. The hi-rail vehicle 10 may have a cab 16 and an equipment bay 14, at least part of which is typically environmentally controlled for use by inspection system operators and for operation of data processing equipment. As used herein, the term "equipment bay" means the sum of all portions of the vehicle 10, other than the cab 16, that may be used for storage of and access to equipment. The cab 16 and the equipment bay 14 need not be separate volumes but may be combined to form an internal cabin within the vehicle 10. It will be understood that portions of the equipment bay 14 may be accessible only from the exterior of the vehicle 10.

The dual nature of a hi-rail vehicle 10 results in inherent limitations with respect to the vehicle's load-carrying capability and the volume available for inspection equipment. Prior art magnetic induction test systems have required such large power supply and generating equipment that use of such systems in conjunction with a hi-rail vehicle was highly impractical, if not impossible. A typical hi-rail vehicle 10 used for track inspection has a load capacity of about 25,000 to 35,000 lbs. The main portion of a typical equipment bay 14 is a space about 7 ft wide, about 6.5 ft high and about 16 ft long, which provides a volume of about 728 cubic feet. Additional volume may provided by externally accessible cabinets.

An additional factor is that the vehicle 10 should be capable of removing, replacing and storing sensing equipment.

The inspection system 100 uses a highly efficient magnetic induction sensor system 130 in combination with a power supply system 102 that makes use of a plurality of small, relatively lightweight power supplies 190 made up of switching power supply modules 196. The power supply system 102 and the data acquisition system 106 are small enough and of sufficiently light weight that they can be housed and operated in a typical hi-rail vehicle 10. The detector system 104 incorporates a relatively light weight detector carriage that can be readily retracted from the rails by the hi-rail vehicle 10 and stowed for highway use of the vehicle 10.

It will be understood by those having ordinary skill in the art that the rail inspection system 100 may be used in conjunction with any vehicle that can house the induction sensor power supply system 102 and the data acquisition system 104 and is capable of propelling the detector carriage 110 along a railroad track. This may include railbound vehicles, non-railbound vehicles convertible for rail use or non-railbound vehicles configured for travel along or above a railroad track.

The following sections describe the various systems of the rail inspection system 100 in detail.

Detector System

Detector Carriage

Figure 11:
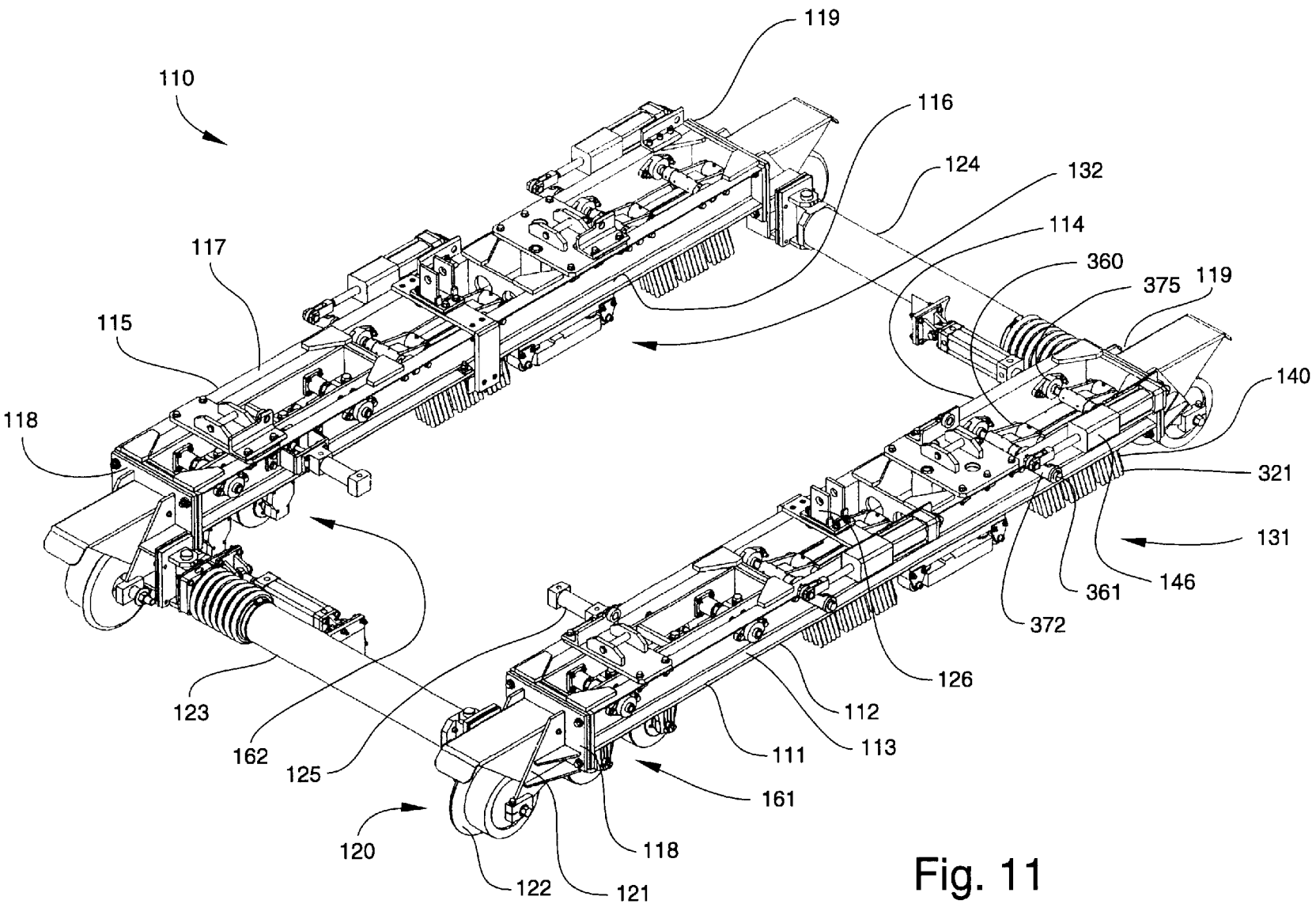
FIG. 11 is a perspective view of a detector carriage of a rail inspection system according to an embodiment of the invention.
Figure 12:
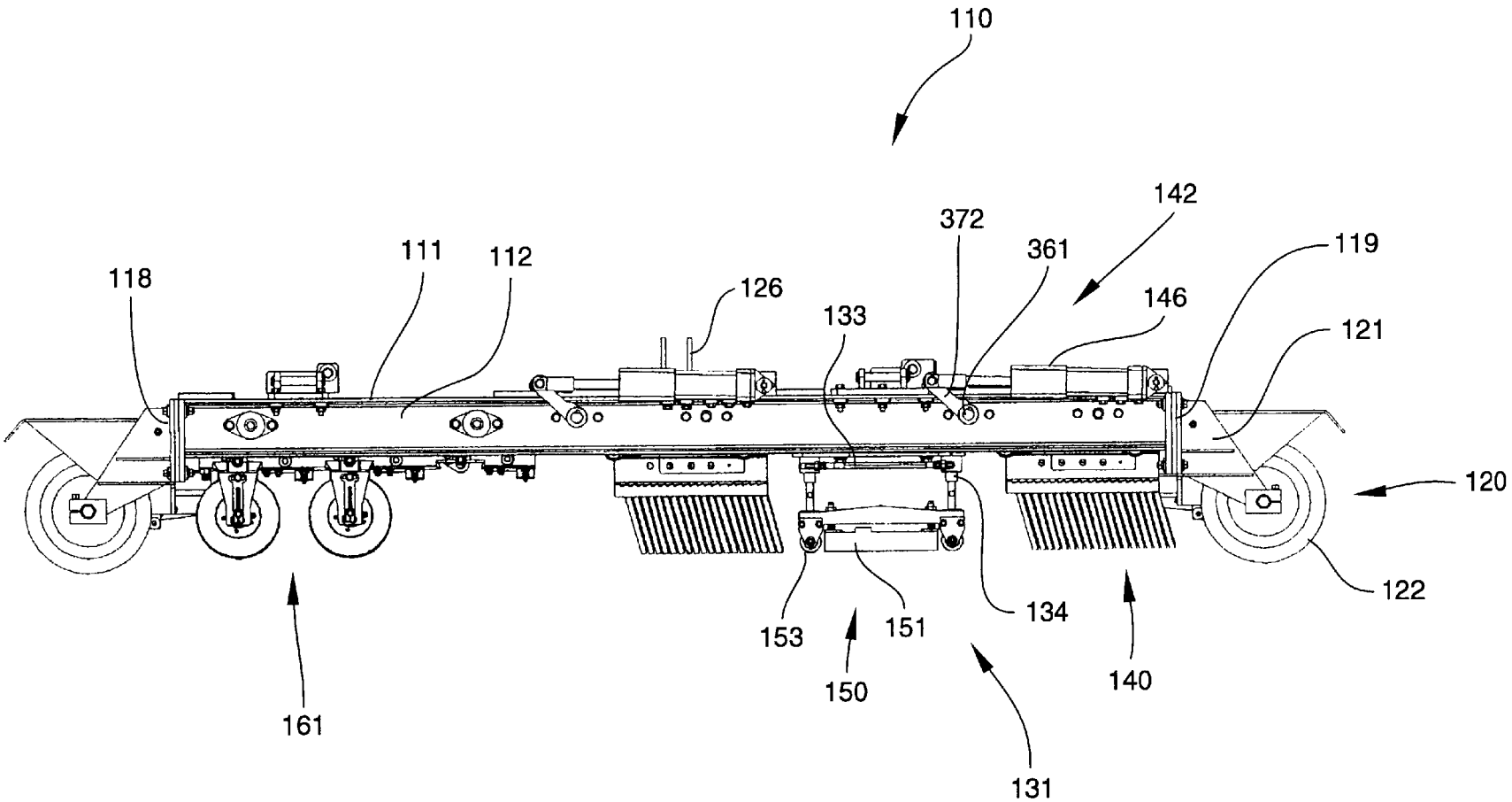
FIG. 12 is a side view of a detector carriage of a rail inspection system according to an embodiment of the invention.
Figure 13:
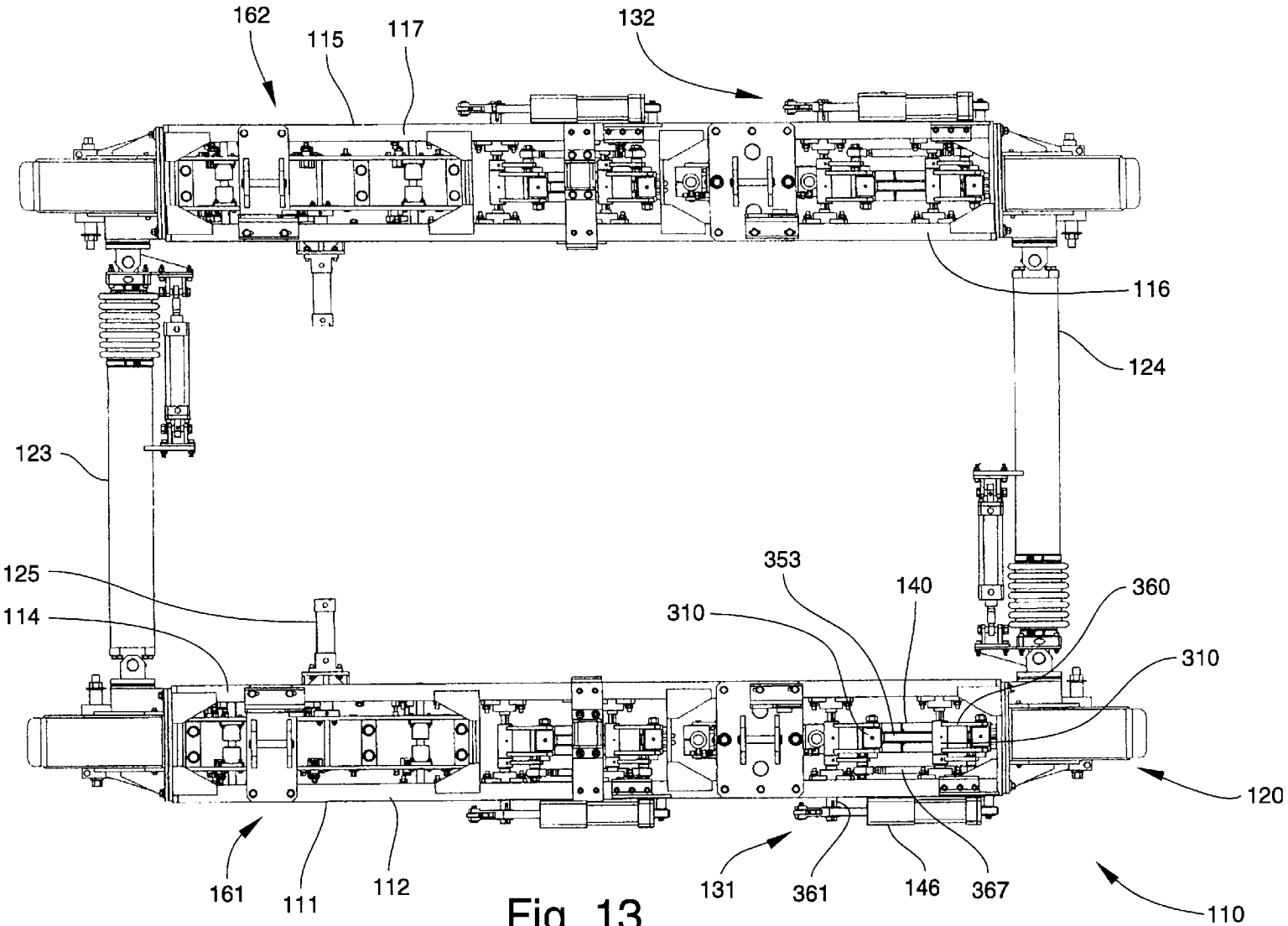
FIG. 13 is a top view of a detector carriage of a rail inspection system according to an embodiment of the invention.

The detector system 104 includes a detector carriage 110, which carries a magnetic induction sensor system 130 and, optionally, an ultrasonic sensor system 160. FIGS. 11–13 illustrate a detector carriage 110 according to an embodiment of the invention. The detector carriage 110 includes a frame 111 having a left side frame rail 112 and a right side frame rail 115. The left side frame rail 112 is formed from a left outside channel 113 and a left inside channel 114 joined by a forward end plate 118 and a rearward end plate 119. The channels 112 and 113 are spaced slightly apart and configured for suspension of sensing equipment from attachment brackets bolted thereto. The right side frame rail 115 is formed from a right inside channel 116 and a right outside channel 117 joined by a forward end plate 118 and a rearward end plate 119. The channels 115 and 116 are also spaced slightly apart and configured for suspension of sensing equipment from attachment brackets bolted thereto. A clevis 126 is attached to the upper side of each frame rail 112, 115 and extends upward therefrom. The devises 126 are positioned near the center of the rail frames 112 and are configured for attachment of a tow bar for towing of the detector carriage 110.

The frame rails 112, 115 may be made from relatively lightweight materials such as aluminum. Steel may also be used, but the use of aluminum reduces the overall weight of the detector system 104 to facilitate stowage of the detector system 104 on-board the hi-rail vehicle 10. Additional weight may be added to the carriage 110 if necessary for stability. Alternatively, the frame rails 112, 115 may be manufactured of heavier materials such as C5 X 9 steel.

In a particular embodiment, the frame rails 112, 115 may be split into forward and rear portions connected at a hinge point. This configuration allows the detector carriage 110 to be at least partially foldable, which can be advantageous for stowage or for storage of the detector carriage 110.

A wheel bracket assembly 120 is attached to each forward end plate 118 and each rearward end plate 119. The wheel assemblies 120 each include a flanged wheel 122 configured for riding over a rail, the flange serving to laterally steer and stabilize the carriage 110 along the track. The wheel 122 rides an axle fitted through a bearing attached to a wheel assembly bracket 121, which is attached to the forward and rearward end plates 118, 119. The wheels 122 are insulated to assure that the carriage 110 is electrically isolated from the rails of the track.

The left and right side frame rails 112, 115 are joined by forward and rearward air/hydraulic gaging cylinders 123, 124. The forward air gaging cylinder 123 is attached to the wheel assembly brackets 121 of the forward wheel assemblies 120 and the rearward air gaging cylinder 124 is attached to the wheel assembly brackets 121 of the rearward wheel assemblies 120. The air/hydraulic gaging cylinders 123, 124 are pneumatically actuated lateral structural members that can be varied in length to adjust the gage of the sensor carriage 110. During rail inspection, the air/hydraulic gaging cylinders 123, 124 are set to maintain constant pressure of the carriage wheel 122 against the rail 2 so as to provide a stable platform for both ultrasonic and induction testing systems. The air/hydraulic gaging cylinders 123, 124 include valving that can be electronically activated to prevent the carriage from being pulled apart and to allow it to compress when traveling over certain rail structures such as crossovers and switch points. When the detector carriage 110 is being stowed using a stowing arrangement 200, the air/hydraulic gaging cylinders 123, 124 may be used to retract the frame rails 112, 115 of the carriage 110 so that the carriage 110 can be rigidly fixed to a stowing frame 210 as will be discussed in more detail hereafter.

The detector carriage 110 may be sized to carry both a magnetic induction sensor system 130 and an ultrasonic sensor system 160, which are discussed in more detail hereafter. While the carriage 110 may be virtually any length, a length of less than about 10 feet may be desirable for a carriage 110 that is to be stowed in or against the back of a hi-rail vehicle 10.

Figure 14:
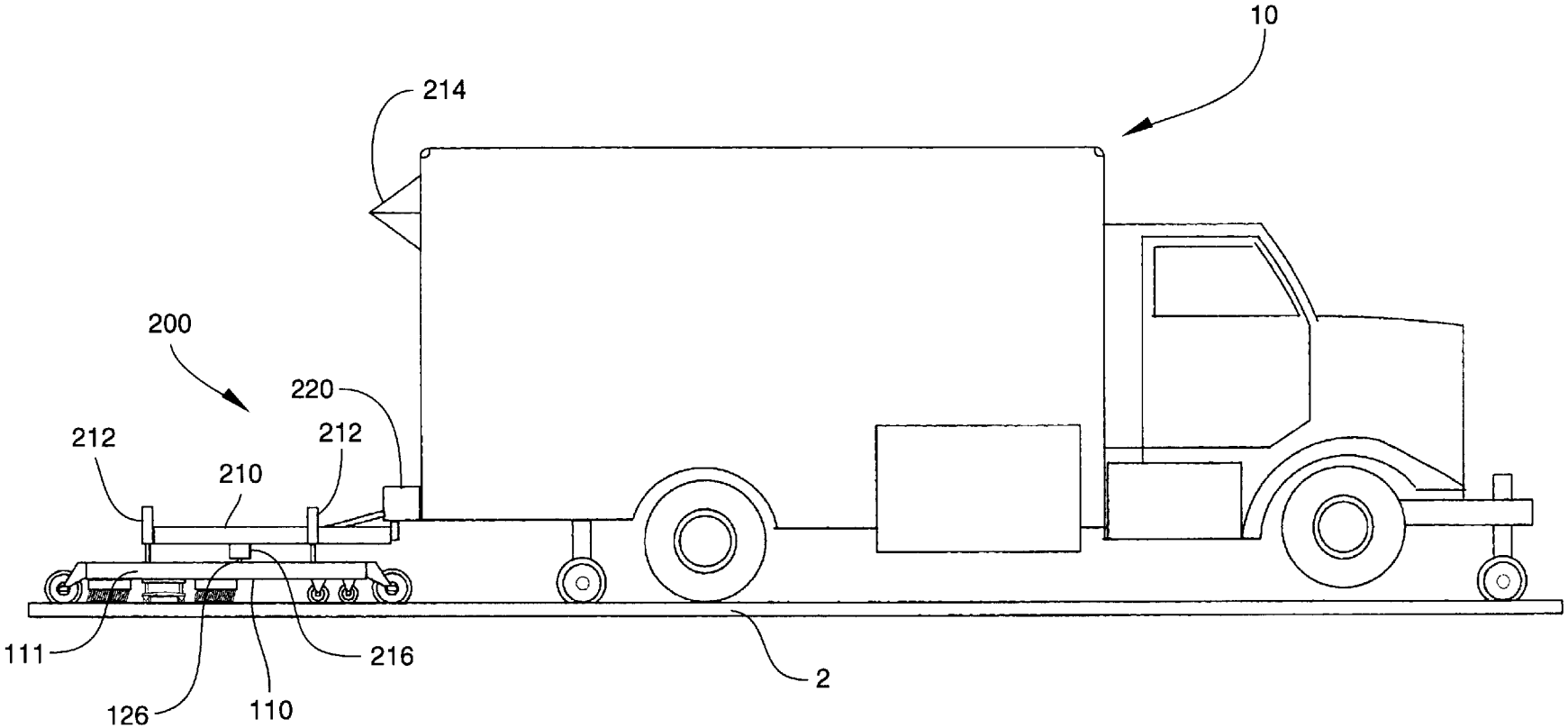
FIG. 14 is a side view illustrating a first position of a detector carriage and stowing frame of a rail inspection system according to an embodiment of the invention.
Figure 15:
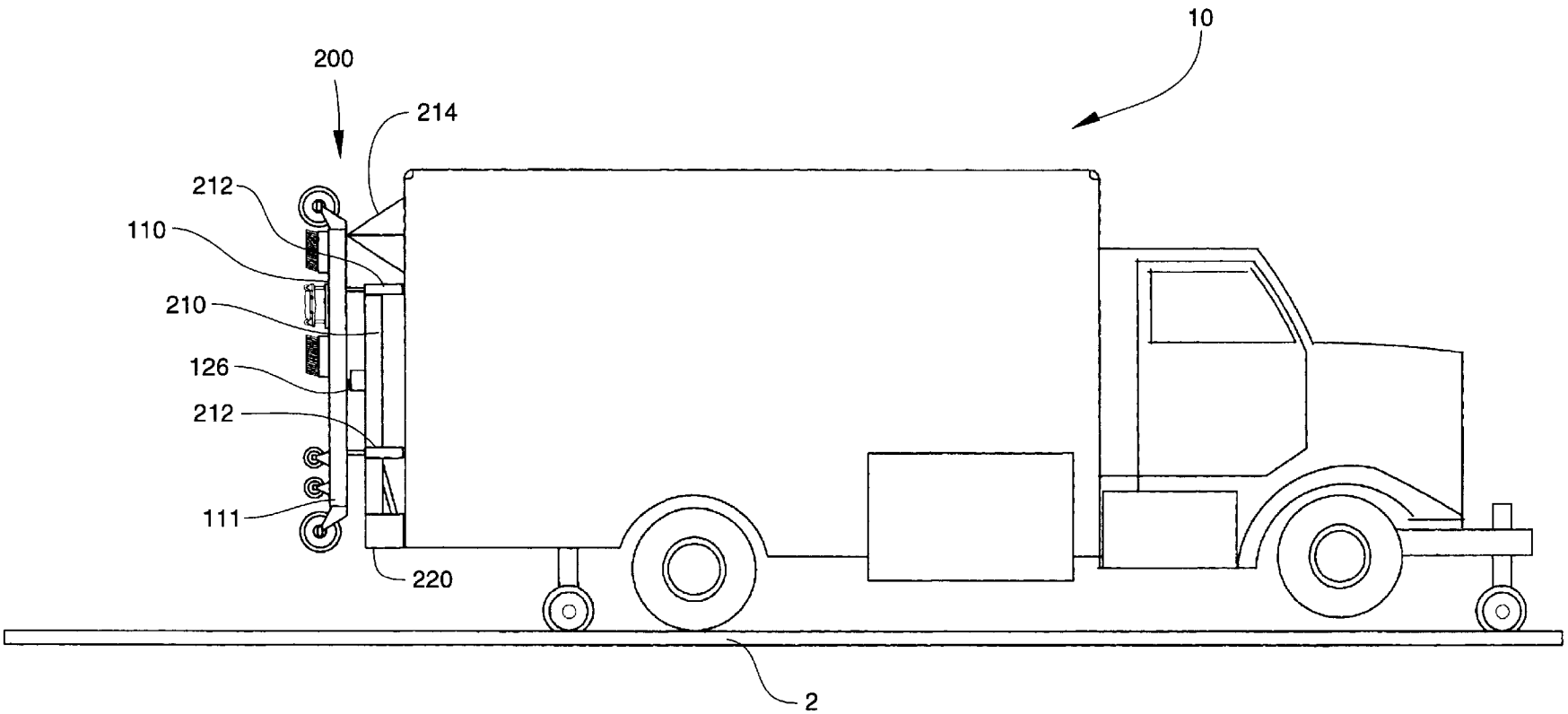
FIG. 15 is a side view illustrating a second position of a detector carriage and stowing frame of a rail inspection system according to an embodiment of the invention.

As illustrated in FIG. 10, a tow bar 127 attached to the clevis 126 of the detector carriage 110 may be used to facilitate the towing of the detector carriage along the rails 2 of a track that is being inspected using the inspection system 100. In a particular embodiment illustrated in FIGS. 14 and 15, the inspection system 100 may include a stowing arrangement 200 that is configured for attachment to the hi-rail vehicle 10 and for lifting the detector carriage 110 from the rails and stowing it against the exterior of the vehicle 10. The stowing arrangement 200 includes a stowing frame 210 that is attached to a hydraulic retraction actuator system 220. The stowing frame 210 includes a plurality of extendible latching mechanisms 212 that are configured for grasping the frame rails 112, 115 of the detector carriage 110 to lock the carriage frame 111 to the stowing frame 210. The hydraulic retraction actuation system 220 is attached to the hi-rail vehicle 10 and is configured to retract the stowing frame 210 from the attachment position illustrated in FIG. 14 to the stowed position illustrated in FIG. 15. When in the stowed position, the detector carriage 110 may be secured to a support structure 214 attached to the rear surface 18 of the hi-rail vehicle 10.

The stowing frame 210 may also act as a tow bar for towing the carriage over railroad rails. When the detector carriage 110 is in position on the rails 2, the latching mechanisms 212 are released. However, a hitch mechanism 216 may be attached to the clevis 126. The hitch mechanism 216 may be configured to swivel to allow for relative motion between the carriage and the towing vehicle 10 in the lateral and vertical planes.

The stowing arrangement 200 securely stows the detector carriage 110 against the back of the hi-rail vehicle 10, thus permitting the hi-rail vehicle 10 to travel at high speed between test points on the railroad track or to leave the track for ordinary road travel. If the stowing arrangement 200 is used, the length of the detector carriage 110 may be configured so as not to extend above the roof of the hi-rail vehicle 10. The use of the stowing frame 210 has the additional benefit of adding rigidity to the structure of the detector carriage 110. This protects the structure when the carriage 110 is removed from the rails and, in particular, when being transported over ordinary roads.

It will be understood that other retraction and/or stowing systems may be used in conjunction with the present invention. These may include, for example, conventional hydraulic lift systems or portable derrick systems. Depending on the configuration of the hi-rail vehicle 10, the detector carriage 110 could be stowed inside the equipment bay 14 or on the roof of the vehicle 10. Vehicles having a high ground clearance could be configured to retract the detector carriage 110 against (or through) the underside of the vehicle.

It will be understood by those having ordinary skill in the art that it may be necessary to add weight to the front of the hi-rail vehicle 10 in order to assure stability on the highway when the detector carriage 110 is in its retracted position. Alternatively, the wheel base of the vehicle may be lengthened. It will also be understood that the carriage 110 could be shortened, particularly if the detector carriage 110 is to be used for magnetic induction testing only.

Magnetic Induction Sensor System

With reference to FIGS. 11–13, the detector system 104 includes a magnetic induction sensor system 130 that is attached to the detector carriage 110. The magnetic inductor sensor system 130 includes a left magnetic induction sensor set 131 for inspection of one rail (left rail) of a track and a right magnetic induction sensor set 132 for inspection of the other rail (right rail). Each induction sensor set 131, 132 includes a pair of brush assemblies 140 and an induction sensor unit (ISU) 150. The brush assemblies 140 are used to saturate the railhead with current, thus establishing a magnetic field around the rail. The ISU 150 is used to detect irregularities in the magnetic field caused by defects within the rail.

Magnetic induction rail inspection involves three major steps that can be described as follows:

1. Passing a heavy current through the rail to be tested, thus establishing a strong magnetic field around the rail.
2. Moving a sensor unit having one or more search coils through the established magnetic field at a fixed distance above the rail.
3. Recording EMF pulses from the coils, such pulses being the result of changes in the magnetic field around the rail at points where internal defects cause a deflection of the current path.

The magnetic induction defect detection method depends on "saturating" the portions of the rail being inspected. The heavier the rail, the more current is required to saturate the rail. In the early days of the application of this technique, rail sections were sufficiently small that the entire cross section of the rail could be "filled" with current. With today's standard 136 lb. rail, the head of the rail is typically the only part of the rail that is filled with current.

The magnetic field resulting from non-defective rail is substantially uniform. Non-uniformity in the rail due to a defect causes the current flow within the rail to be irregular, which in turn results in a change in the profile of the magnetic field surrounding the rail head. The type and magnitude of the distortion can be correlated to particular types of defects such as a vertical split head defect.

The magnetic field is evaluated by passage of the ISU 150 through the magnetic field. As the search coils of the ISU 150 are passed along the top of the rail through the magnetic field, current is induced in the coils. Based on the known orientations of the coils and the speed of the sensor unit over the rail, a multidimensional "view" of the magnetic field may be formed based on the current in the coils. Distortions in the rail cause a detectable change in the induced current.

As the ISU 150 is passed through the magnetic field, the generated current is passed to an amplifier. The resulting amplified signal is processed by the data processing system 170 and provides the basis for generating visual output and marking of the locations of identified defects.

Under certain circumstances, additional defect information can be gleaned from the wave form generated as a result of the distortion in the magnetic field. Analysis of the waveform can include comparison with models derived from particular defects. This can allow particular defects to be recognized along with their size and location within the rail.

The ISU 150 is attached to a retraction arrangement 133. The retraction arrangement 133 of the left magnetic induction sensor set 131 is attached to the left side frame rail 112 by brackets so that the ISU 150 is suspended from the left side frame frail 112 as shown in FIG. 104. The retraction arrangement 133 of the right magnetic induction sensor set 132 is similarly attached to the right side frame rail 113. The retraction system 133 includes air cylinders 134 that allow the ISUs 150 to be selectively raised and lowered. The retraction system 133 may be configured so that when raised, the ISU 150 clears the rail surface by a minimum of ½". An electrical or mechanical locking arrangement may be provided to prevent the ISU 150 from dropping into gaps in the rail.

The ISU 150 includes a coil housing 151 suspended from a frame member 152. The coil housing 151 is maintained at a constant distance above the rail surface by means of guide rollers 153.

Each ISU 150 provides four channels of data per rail. Each channel provides signals from one or more pairs of differentially wound coils mounted within the coil housing 151. These coils are referred to as the C, D and F&G coils based on their orientation relative to the rail surface. The C coil is oriented in parallel with the railhead surface and parallel to the axis of the rail. The D coil is oriented vertically perpendicular to the long axis of the rail. The F&G coil is oriented parallel to the upper surface of the rail and transverse to the long axis of the rail.

It will be understood by those having ordinary skill in the art that the ISU 150 could include other forms of magnetic flux sensing devices such as Hall effect sensors.

In general, good results can be obtained from induction inspection only if a consistent magnetic field is maintained around the rail being inspected. This requires that the saturation current be consistently maintained in the rail. This, in turn, requires uninterrupted flow of electricity between the rail and the contacts used to apply the saturation current to the rail. Heretofore, this has generally been accomplished using solid blocks of a highly conductive material such as copper. Embodiments of the magnetic induction system 130 of the present invention use conductive brushes instead of solid blocks.

Figure 16:
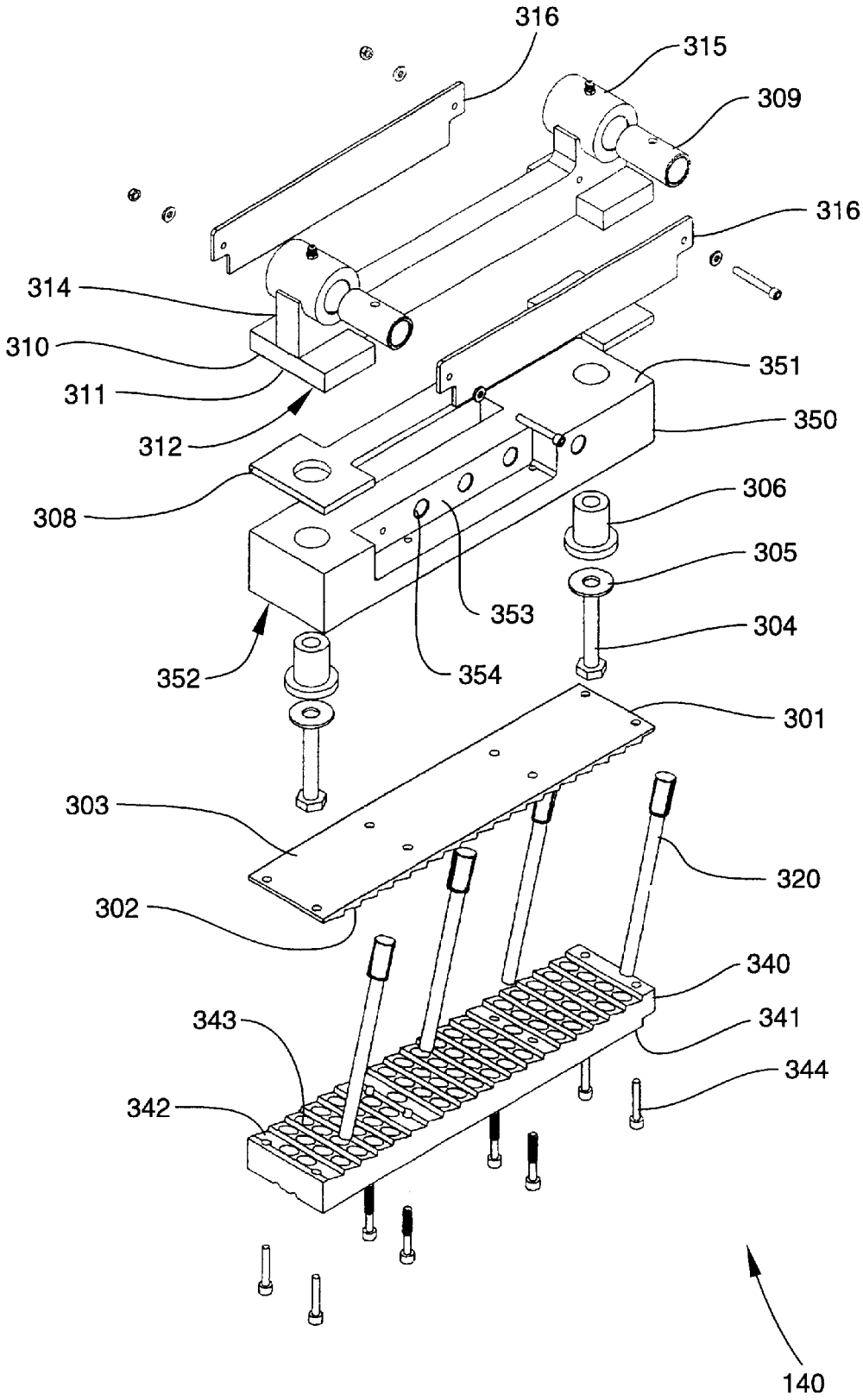
FIG. 16 is an exploded perspective view of a brush assembly of a rail inspection system according to an embodiment of the invention.
Figure 17:
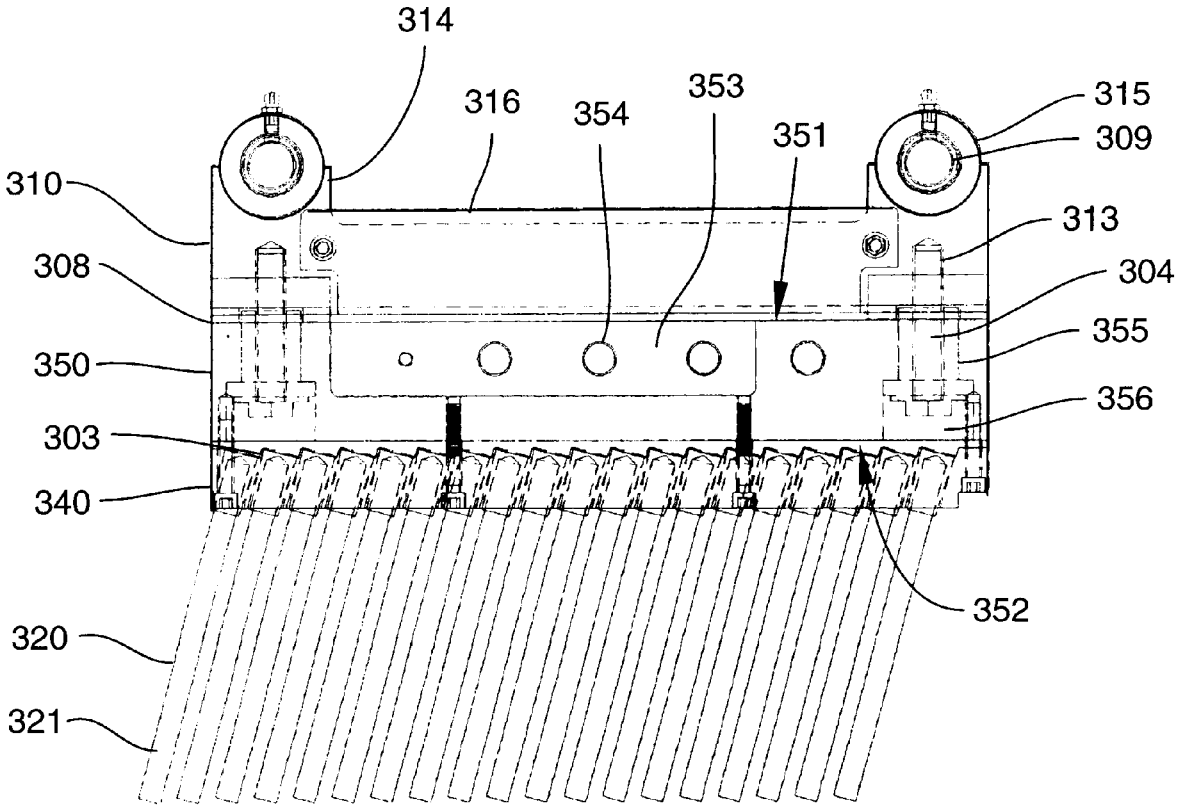
FIG. 17 is a front view of a brush assembly of a rail inspection system according to an embodiment of the invention.

Accordingly, each magnetic induction sensor set 131, 132 includes two brush assemblies 140. One of the two brush assemblies 140 is mounted to each frame rail 112, 115 by an actuation assembly 142 forward of the ISU 150 and one of the brush assemblies 140 is mounted to each frame rail 112, 115 by a second actuation assembly 142 rearward of the ISU 150. The brush assembly 140, which is illustrated in detail in FIGS. 16 and 17, is a novel "solid state" assembly. The brush assembly 140 includes a bristle holder 340 having a plurality of holes 343 for receiving a plurality of bristle assemblies 320. The bristle holder 340 is attached to a bus block 350 with an adaptor plate 303 sandwiched therebetween. The bus block 350 is attached to a brush holder 310, which is configured for attachment to a brush actuation assembly as will be discussed hereafter.

The bristle holder 340 is formed as a unitary block of material with a substantially flat lower surface 341 and a serrated upper surface 342. The bristle holder 340 has an array of holes 343 drilled through the upper and lower surfaces 341, 342. The holes 343 are formed in the bristle holder 343 at an angle selected to provide a particular angle of the bristle assemblies 320 with respect to the upper surface of the rail 2. The serrations in the upper surface 342 of the bristle holder 340 are machined so as to be perpendicular to the axes of the holes 343. The pattern of the array of holes 343 is arranged so as to provide an optimized contact footprint on the rail 2. The bristle holder 340 is not required to conduct electricity and therefore may be formed from any material having sufficient strength to rigidly hold the bristle assemblies 320 in place. Such materials may include but are not limited to steel, stainless steel, phenolic or other heavy duty plastic.

Figure 18:
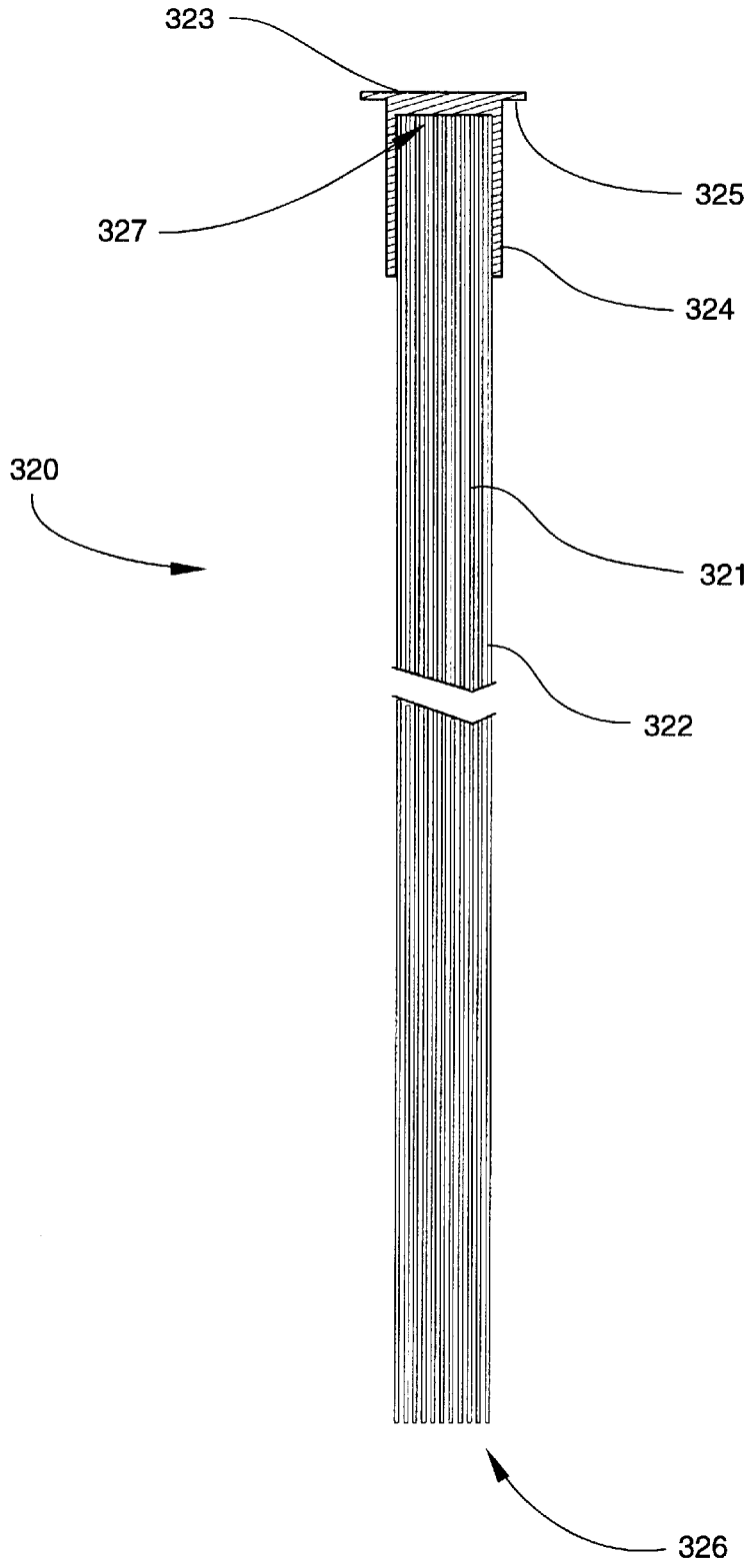
FIG. 18 is a section view of a bristle assembly of a rail inspection system according to an embodiment of the invention.

The bristle assemblies 320 each comprise a bristle 321 formed from a bundle of straightened wire elements 322 and a cap 323 as shown in FIG. 18. The straightened wire elements 322 are formed from wire stock selected to provide a combination of stiffness, durability and conductivity. The wire stock may be formed, for example, from copper, copper alloys, steel or beryllium. A beryllium copper alloy has been found to provide a particularly suitable combination of wear and conductivity.

The cap 323 is formed as a cylindrical sleeve 324 closed at one end by a flange portion 325. The diameter of the cylindrical sleeve 324 is slightly smaller than the diameter of the holes 343. The bristle 321 has a proximal end 327 configured for insertion into the cap 323 and a distal or contact end 326. The proximal end 327 of the bristle 321 is secured to the cap 323 by soldering. The cap 323 is formed from a high conductivity material such as copper to facilitate conduction of current between the bus block 350 and the bristle 321. For a cap 323 having an internal diameter of about 7/16 in., the bristle 321 may comprise from about 125 to about 145 wire elements 322 having a diameter of about 0.030 in. It will be understood by those having ordinary skill in the art that larger or smaller diameter wire elements 322 may be used with a resulting change in the number of elements that may be bundled to form the bristle 321.

The bristle assemblies 320 are each inserted into a hole 343 in the bristle holder 340 so that a portion of each bristle 321 extends downward and rearward from the lower surface 341 of the bristle holder. The flange portion 325 of the cap 323 has a larger diameter than the holes 343 so that the flange portion 325 engages the upper surface of the bristle holder 340. In an alternative embodiment, the cap 323 may be formed as a tapered sleeve. In this embodiment, the holes 343 in the bristle holder may be tapered so that the outer surface of the tapered sleeve contacts the inner surface of the tapered hole.

The flange portions 325 of the caps 323 are held in place by an adaptor plate 301. The adaptor plate 301 is formed of a highly conductive material such as copper and is formed with a lower surface 302 having serrations that are complementary to those of the upper surface 342 of the bristle holder 340. The upper surface 303 of the adaptor plate 301 is substantially flat to conform to the bottom of the bus block 350 for engagement therewith.

The bristle holder 340 is attached to the bus block 350 with the bristle assemblies 320 in place in the holes 343 of the bristle holder 340 and the adaptor plate 301 in place over the upper surface 342 of the bristle holder 340. The bristle holder is attached by threading machine screws 344 through holes in the bristle holder 340 and the adaptor plate 301 into threaded holes on the underside of the bus block 350. When assembled in this manner, a low resistance electrical path is provided between the bus block 350 and each bristle 321 through the adaptor plate 301 and the bristle's associated cap 323.

The exposed portion of the bristles 321 will have an initial length that will be reduced over time as the inspection system 100 is used. As will be discussed hereafter, the brush assembly 140 is attached to a brush actuation assembly 142 that maintains a downward force on the brush assembly 140 to maintain contact of the bristles 321 with the rail 2 as the bristles 321 decrease in length through wear. When the bristles 321 are reduced to a length that is no longer acceptable, the bristle holder 340 may be detached from the bus block 350 and the bristle assemblies 320 replaced.

The bus block 350 is formed as a solid, generally rectangular block of highly conductive material such as copper. The bus block 350 has substantially flat upper and lower surfaces 351, 352. A cable attachment portion 353 is formed in the upper surface 351 of the bus bar 350. The cable attachment portion 353 is essentially a bar having cable attachment holes 354 formed therethrough. The bus block 350 has two attachment holes 355 formed through the upper and lower surfaces 351, 352. These attachment holes 355 are each configured to receive an insulator sleeve 306, which is used to insulate the attachment bolt 304 and washer 305 used to attach the bus block 350 to the brush holder 310. The insulator sleeve 306 prevents the attachment bolt 304 from contacting the bus block 350. The holes 355 include a recessed portion 356 on the lower surface 352 so that when the bus block 350 is attached to the brush holder 310, the head of the attachment bolt 304 is received into the hole 355 in its entirety. This assures that when the adaptor plate 303 and the bristle holder 340 are attached to the bus block 350, the bolt head cannot make contact with the adaptor plate 303.

The brush holder 310 has a base portion 311 having a flat lower surface 312 for engaging the upper surface 351 of the bus block 350. Two threaded holes 313 are formed through the lower surface 312 for receiving the bus block attachment bolts 304. The brush holder 310 has two pedestals 314 attached to the base portion 311. Two cylindrical sleeves 315 are mounted to the pedestals 314. The cylindrical sleeves 315 are mounted transversely to the long axis of the brush holder 310 and are each configured to receive a bearing 309. The bearing 309 is configured to receive a shaft 144 of the brush actuation assembly 142 as will be discussed hereinafter.

The brush holder 310 may be manufactured out of any suitable structural material including steel, aluminum and structural plastic. In an illustrative embodiment, the base portion 311, the pedestals 314 and the cylindrical sleeves 315 are integrally formed from a single block of aluminum. If formed from a conductive material, the brush holder 310 may be provided with a pair of side insulating plates 316. These insulating plates 310, formed from phenolic or similar insulating material, are attached to the central portion of the brush holder base portion 311 to prevent inadvertent electrical contact between the brush holder 310 and cables attached to the cable attachment portion 353 of the bus block 350.

In order to electrically isolate the brush holder 310 from the bus block 350, a phenolic spacer 308 is disposed intermediate the lower surface 312 of the brush holder 310 and the upper surface 351 of the bus block 350. The phenolic spacer 308 is configured to match the shape of the lower surface 312 of the brush holder 310.

Figure 19:
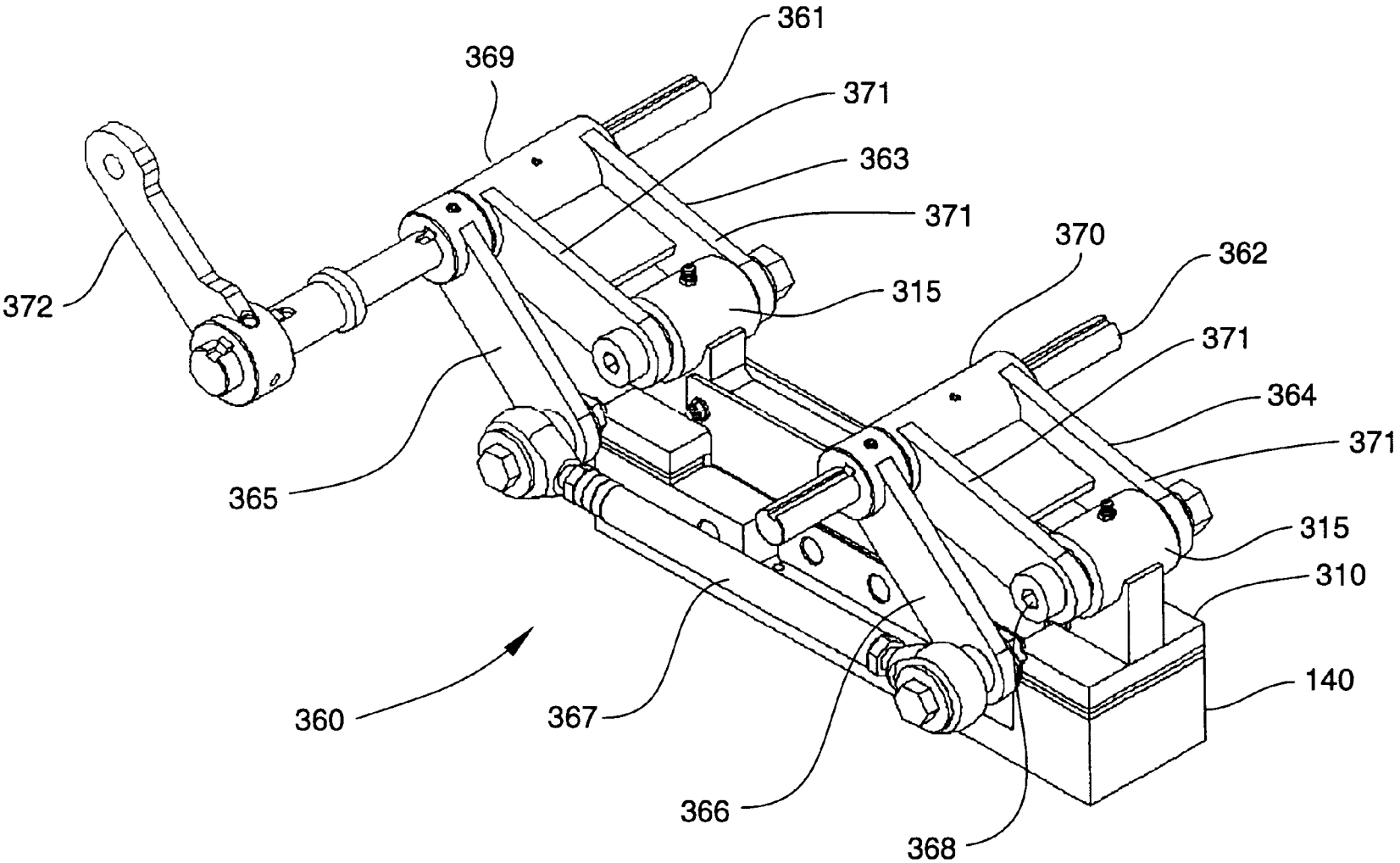
FIG. 19 is a perspective view of a brush assembly and a linkage assembly of a rail inspection system according to an embodiment of the invention.

The actuation assembly 142 includes a pneumatic actuator 146 and a linkage assembly 360 to which the brush assembly 140 is attached. FIG. 19 illustrates the attachment of the brush assembly 140 to the linkage assembly 360. The linkage assembly 360 includes first and second shafts 361, 362 mounted on pillow block bearings 375 for mounting intermediate the inside channel 114, 116 and the outside channel 113, 117 of the frame rail 112, 115. The linkage assembly 360 also includes forward and rearward brush link assemblies 363, 364, forward and rearward connecting rod links 365, 366, an adjustable connecting rod 367 and two brush holder pins 368 configured for insertion into the bearings 309 of the brush holder 310. The brush link assemblies 363, 364 include cylindrical mounts 369, 370 to which shafts 361, 362 are respectively non-rotatably mounted. A pair of link members 371 extends from each of the cylindrical mounts 369, 370. The cylindrical sleeves 315 of the brush holder 310 are positioned between each pair of link members 371 and are secured thereto by brush holder pins 368 rotatably disposed through the bearings 309. The connecting rod 367 is attached at its ends to the forward and rearward connecting rod links 365, 366. The forward connecting rod link 365 is non-rotatably attached to the first shaft 361. The rearward connecting rod link 366 is non-rotatably attached to the second shaft 362. The first shaft 361 extends through the outside channel 113, 117. A crank 372 is attached to the outer end of the first shaft 361 and to the rod of a pneumatic actuator 146 attached to the outside channel 113, 117. The linkage assembly 360 is configured so that retraction of the rod of the pneumatic actuator 146 causes the rotation of the crank 372 which causes the linkage assembly 360 to lower the brush assembly 140. Conversely, extension of the rod of the pneumatic actuator 146 causes the linkage assembly 360 to raise the brush assembly 140.

The adjustable connecting rod 367 allows the operator to control the brush orientation relative to the rail surface. Making the connecting rod 367 longer causes the rear portion of the brush assembly 140 to lift and, conversely, making the connecting rod 367 shorter causes the rear portion of the brush assembly 140 to lower. These types of adjustments are carried out for each brush assembly to assure they are substantially parallel with the rail surface to assure even wear of the bristles 321.

The pneumatic actuator 146 may be controlled so as to lower the brush assembly 140 until the bristles 321 make contact with the rail 2 and then maintain a selected downward force on the brush assembly 140 to assure that electrical contact is maintained between the bristles 321 and the rail 2. In addition to assuring continued contact over uneven rail surfaces, this feature assures that contact may be maintained as the bristles 321 wear to shorter and shorter lengths. The downward force is limited to assure that too much force is not applied. If too much force is applied by the pneumatic actuator 146, the frame rail may be forced upward, which in turn could cause the carriage 110 to derail. The pneumatic actuator 146 may also be controlled so as to selectively retract the brush assembly 140 away from the rail 2. The actuation assembly 142 maybe designed so that at least 0.5 in. of clearance is provided between the brush assembly 140 and the rail 2 when the bristles 321 are new. The pneumatic actuator 146 may include a mechanical or electrical locking system that locks the brush assembly 140 in the retracted position.

The brush assemblies 140 are positioned so that the bristles 321 are angled toward the rear of the detector carriage 110, the rear being defined as the direction opposite the direction of motion of the detector carriage 110 during rail inspection. The angle may be any angle in a range from 0 to 45 degrees from the vertical and is preferably in a range from about 10 to 30 degrees from the vertical. An angle of 15 degrees has been particularly successful in maintaining a balance between required down force and continuous electrical contact. Angles nearer the vertical have been shown to be somewhat less reliable.

The actual current applied to the rail may be monitored and included in the data provided to the data acquisition system 106.

The brush assemblies 140 provide a large contact footprint and have demonstrated consistent current continuity and excellent wear characteristics. When the bristles 321 wear down, the bristle assemblies 320 are easily replaceable.

Ultrasonic Sensor System

With further reference to FIGS. 11–13, the detector system 104 may includes an ultrasonic sensor system 160 that is attached to the detector carriage 110. The ultrasonic sensor system 160 includes a left ultrasonic sensor set 161 for inspection of the left rail of a track and a right ultrasonic sensor set 162 for inspection of the right rail. Each ultrasonic sensor set 162 includes one or more roller search units (RSUs) 163 supported by an RSU frame 164. Each RSU 163 comprises a fluid-filled wheel 165 formed of a pliant material that deforms to establish a contact surface when the wheel 165 is pressed against the rail 2. The fluid-filled membrane is mounted on an axle attached to the RSU frame so that the fluid-filled wheel contacts the rail 2 and rolls along the rail 2 as the detector carriage 110 is pulled along the track. The RSU 163 includes ultrasonic transducers mounted inside the fluid-filled wheel 165. The ultrasonic transducers are configured and positioned for transmitting ultrasonic beams through the fluid in the wheel 165 and through the contact surface into the rail 2 and for receiving the reflected beams from the rail 2.

The ultrasonic transducers generate return signals that are transmitted to the data acquisition system 106 where they are amplified and processed. Certain disruptions in the signal can be interpreted as rail defects and certain types of defects will reflect a characteristic signal such that when the characteristic signal is received, the type of defect may be readily determined.

Figure 20:
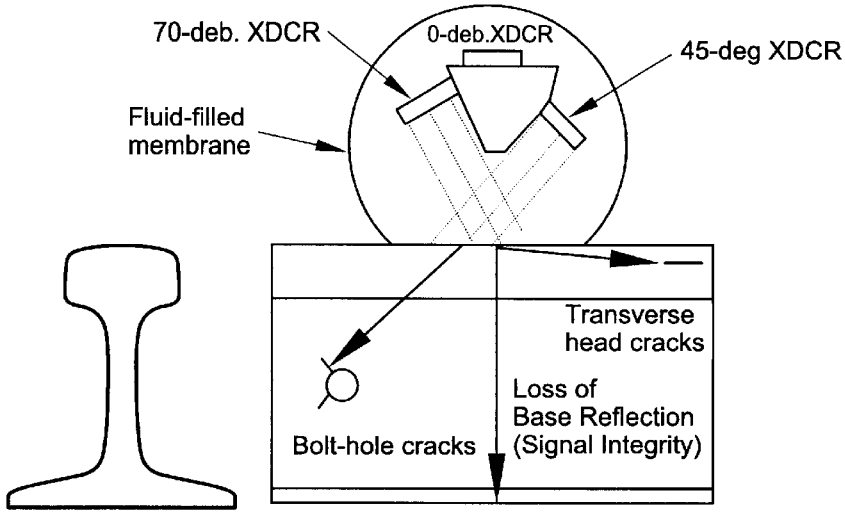
FIG. 20 is a schematic representation of an exemplary ultrasonic roller search unit.
Figure 21:
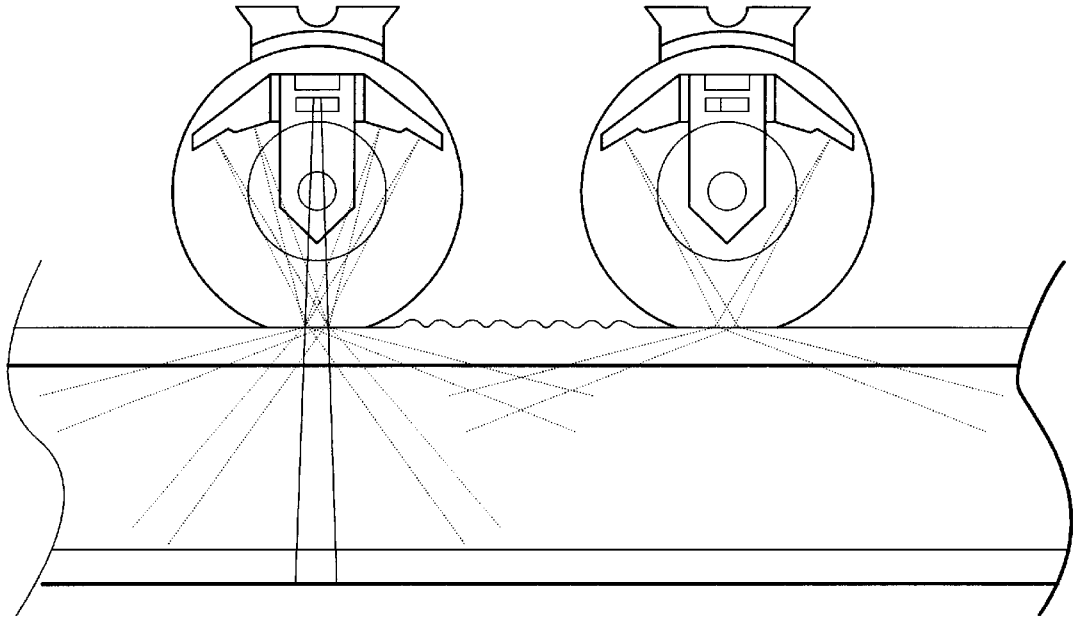
FIG. 21 is a schematic representation of a pair of exemplary ultrasonic roller search units.

An exemplary RSU that is usable in the present invention is shown schematically in FIG. 20. In this example, one transducer is oriented at 45° so as to identify angled defects such as bolt hole cracks. Another transducer is oriented at 70° from the vertical in order to detect transverse head cracks. A vertical transducer is used to provide a baseline signal indicative of signal integrity. FIG. 21 illustrates another exemplary array of ultrasonic transducers configured to cover specific areas of the rail cross section wherein defects are likely. Ultrasonic transducers may also be mounted laterally away from the centerline of the rail and angled back toward the center of the rail. These "cross-rail" transducers can be used to assist in detecting vertical split head defects.

The ultrasonic sensor system 160 may include RSUs 163 of more than one type so that a variety of defects may be assessed. The RSU frame 164 may be configured to support any number of RSUs 163. The RSU frame 164 is slidably mounted to two support shafts 165 disposed between and attached to the inside channel 114, 116 and the outside channel 113, 117 of the frame rail 112, 115. The RSU frame 164 and the RSUs 163 are thus laterally movable to so that the RSUs 163 may be centered on the rail 2. A lateral control cylinder 125 attached to the inside channel 114, 116 is operatively connected to the RSU frame 164. The lateral control cylinder 125 controls the lateral position of the RSU frame 164 and the associated RSUs 163. The lateral control cylinder 125 can be used to alter the lateral position of the RSU frame 164 on command or can be configured to automatically maintain the RSU frame 164 in a position where the RSUs are centered on the rail 2. This feature is of particular value because of the tendency of the RSUs 164 to drift off-center when the track is curved.

Power Supply System

In order to achieve satisfactory results from the magnetic induction sensor system 130, the brush assemblies 140 should be capable of transmitting high current levels (up to about 4000 amps DC) to the rail at a voltage between about 0.5 and about 3.5 volts. Higher voltages could be used but are generally discouraged by the railroads because of concerns regarding damage to signals and sensing equipment associated with the track. A preferable current range for defect detection is about 2500 to 3600 amps DC at a voltage between 3 and 3.5 volts.

Prior art magnetic induction rail inspection systems have required large rectifier packs to supply these high current levels. This approach is not practical for use in non-railbound vehicles because of the size and weight of the resulting power supply. The present invention makes use of a plurality of relatively small, high-powered switching power supply modules that can easily be housed within the equipment bay 14 of a typical hi-rail vehicle 10.

Figure 22:
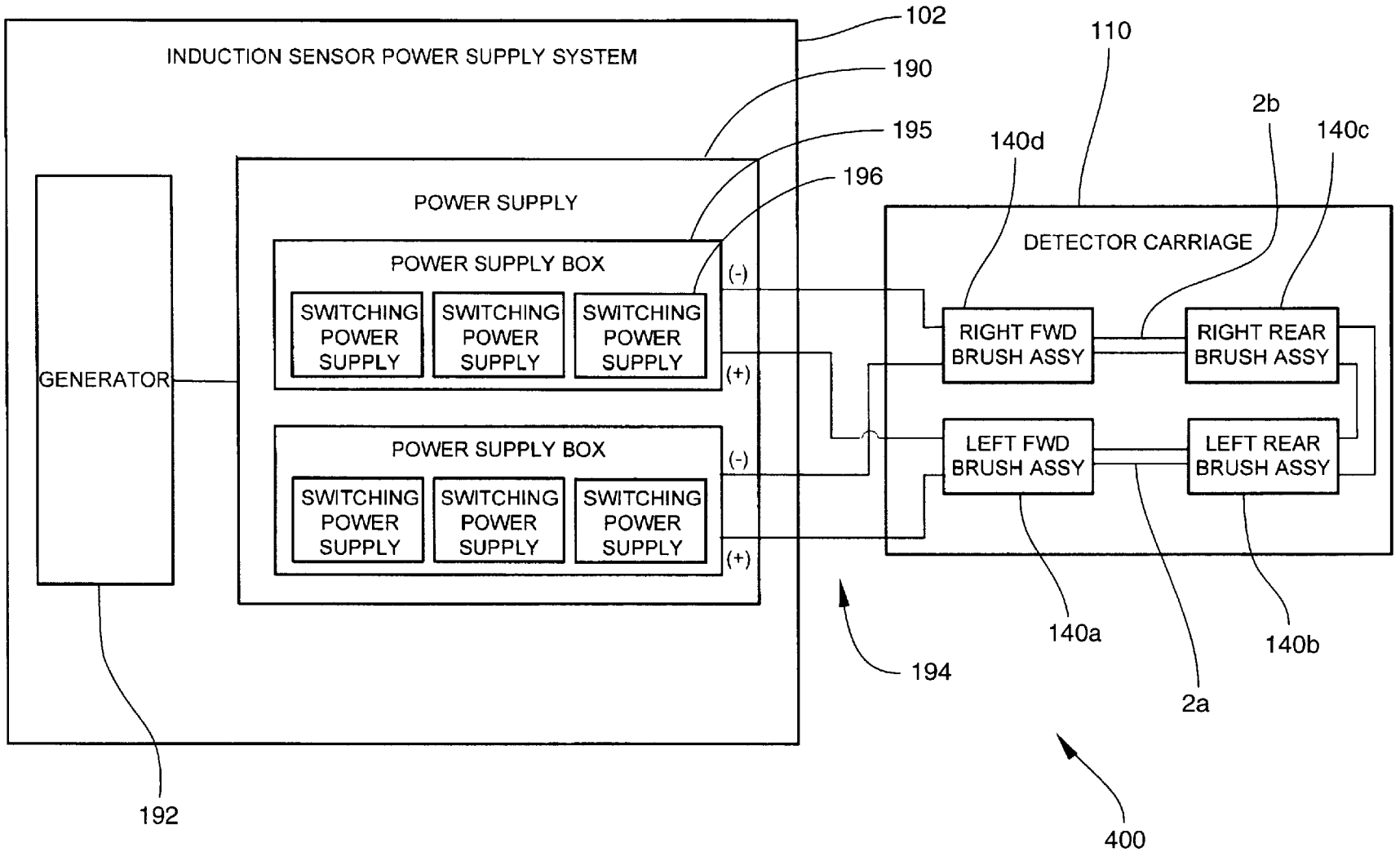
FIG. 22 is a schematic representation of an induction sensor power supply system of a rail inspection system according to an embodiment of the invention.

The inspection system 100 includes a power supply system 102 configured to provide up to 3600 amps DC at 3.3 volts to the induction sensor system 130. With reference to FIG. 22, the power supply system 102 includes a generator 192 connected to a power supply 190 and a cable arrangement 194 for connecting the power supply 190 to the brush assemblies 140. The generator 192 is a diesel-powered or gasoline-powered AC generating system capable of providing at least 15–22 kW and preferably at least 20 kW of power at between 220 and 230 volts AC. The generator 192 may provide either single phase or three phase AC output. A representative generator 192 provides 21 kW of power at 220 volts single phase AC. The generator 192 may be driven by the vehicle engine or a separate engine. The generator 192 will typically be driven by a separate engine stored in an externally accessible cabinet attached to the body or chassis of the vehicle 10.

The power supply 190 comprises two sets of three high-powered switcher power supply modules 196 configured for use with a single phase or three phase AC generator output. Each power supply module 196 can provide up to about 600 amps DC at 3.3 volts and is equipped with power factor correction to ensure consistent power output. An exemplary switching power supply module series suitable for use in the invention is the LV3011 series of power switching supplies manufactured by Power One, Inc., Irvine, Calif. The output of the three power switching modules 196 in each set of three power switching modules 196 may be combined and the output from the two sets may be further combined to produce an overall power supply capacity of 3600 amps at 3.3 volts.

Each set of three switching power supply modules 196 is housed in a power supply box 195. The power supply boxes 195 are approximately 20 in. by 24 in. by 12 in. and are preferably housed near the back of the equipment bay 14 of the vehicle 10 in order to minimize the cabling required to reach the detector carriage 110. Because the switching power supply modules 196 generate heat, cooling fans may be installed in the power supply boxes 195. The overall weight of each power supply box 195 with three LV3011 series switching power supply modules 196 installed therein is only about 100 lbs.

The power supply 190 provides current to both the left side and right side magnetic induction sensor sets 131, 132 through a single power supply circuit. In this power supply circuit, current flows from the power supply 190 through the cable arrangement 194 to one of the brush assemblies 140 on one side of the detector carriage 110. That brush assembly 140 conducts the current into the rail 2 on that side of the carriage 110. The current then passes up through the other brush assembly 140 on the same side of the carriage 110. The cabling arrangement 194 is then used to pass the current to one of the brush assemblies 140 on the opposite side of the detector carriage 110, which conducts the current into the rail 2 on that side of the carriage. The current passes up through the other brush assembly 140 on that side and is returned to the power supply 190 by the cable arrangement 194.

FIG. 22 illustrates an exemplary power supply circuit 400. Current passing through the circuit 400 passes from the power supply 190 through one or more cables of the cable arrangement 194 to the left front brush assembly 140*a*, into and through the rail 2*a* to the left rear brush assembly 140*b*, to the right rear brush assembly 140*c* through one or more cables of the cable arrangement 194, into and through the rail 2*b* to the right front brush assembly 140*d* and back to the power supply 190 through one or more cables of the cable arrangement 194. It will be understood that other orders of current flow are also possible as long as the current is flowed firs through the brush assemblies 140 on one side of the carriage 110 then through the brush assemblies on the other side of the carriage 110. As shown in FIG. 22, power is supplied to the carriage 110 from the two power supply boxes 195, and thus all six of the switching power supply modules 196, in parallel.

The cables used to interconnect the power supply 190 and the brush assemblies are preferably AWG #4/0 cables. Eight such cables are used for each cable leg in the power supply circuit 400; i.e., between the power supply 190 and the brush assemblies 140*a* and 140*d* and between the brush assemblies 140*c* and 140*d*. The cables are attached to the brush assemblies 140 using standard connectors to connect the cable ends to the cable attachment portion 353 of the bus block 350. All cable lengths are kept to minimum practical lengths in order to minimize resistance losses.

It will be understood by those having ordinary skill in the art that the single power supply circuit 400 could be replaced with separate circuits for each side of the detector carriage 110. However, this requires increased complexity and additional cable. Prior art magnetic induction systems have generally required separate power supply circuits for operational reasons. Specifically, the contacts of prior art magnetic induction systems must generally be raised off the rail when the detector system passes over the frog of a switch. If this is not done, the contact can be damaged. Because it is desirable to continue evaluation of the opposite rail as the system passes through the switch, the detector on that rail is powered separately. If the two detectors were on the same circuit, the raising of the contacts on one side would remove current from the opposite side. The brush assemblies 140 contact the rail with a multiplicity of bristle elements 322 that are sufficiently flexible and resilient that the brush assembly 140 need not be raised when small impediments such as switch frog is encountered. As a consequence, there are very few instances where the brush assemblies 140 on only one side are raised.

It will be understood that although the brush assemblies 140 generally need not be raised when small impediments are encountered, it may be necessary to raise the ISU 150 to prevent damage to the ISU 150. This, however, has no effect on data from the other rail.

It will be understood that the power supply system 102 could be used in conjunction with other magnetic induction inspection systems as well and in particular could be used to replace power supply systems used in railbound inspection vehicles.

Data Processing

Regardless of the method of sensing rail defects, sensor signals must be sorted and processed through carefully defined data logic for presentation to the test operator. False returns must be held to a minimum. The economy of track time is of paramount importance to railroad operators. Accordingly, detection of flaws is ideally accomplished in "real time." Data output should be clear and concise so that the operator can make quick decisions as to the validity of a defect indication.

Figure 23:
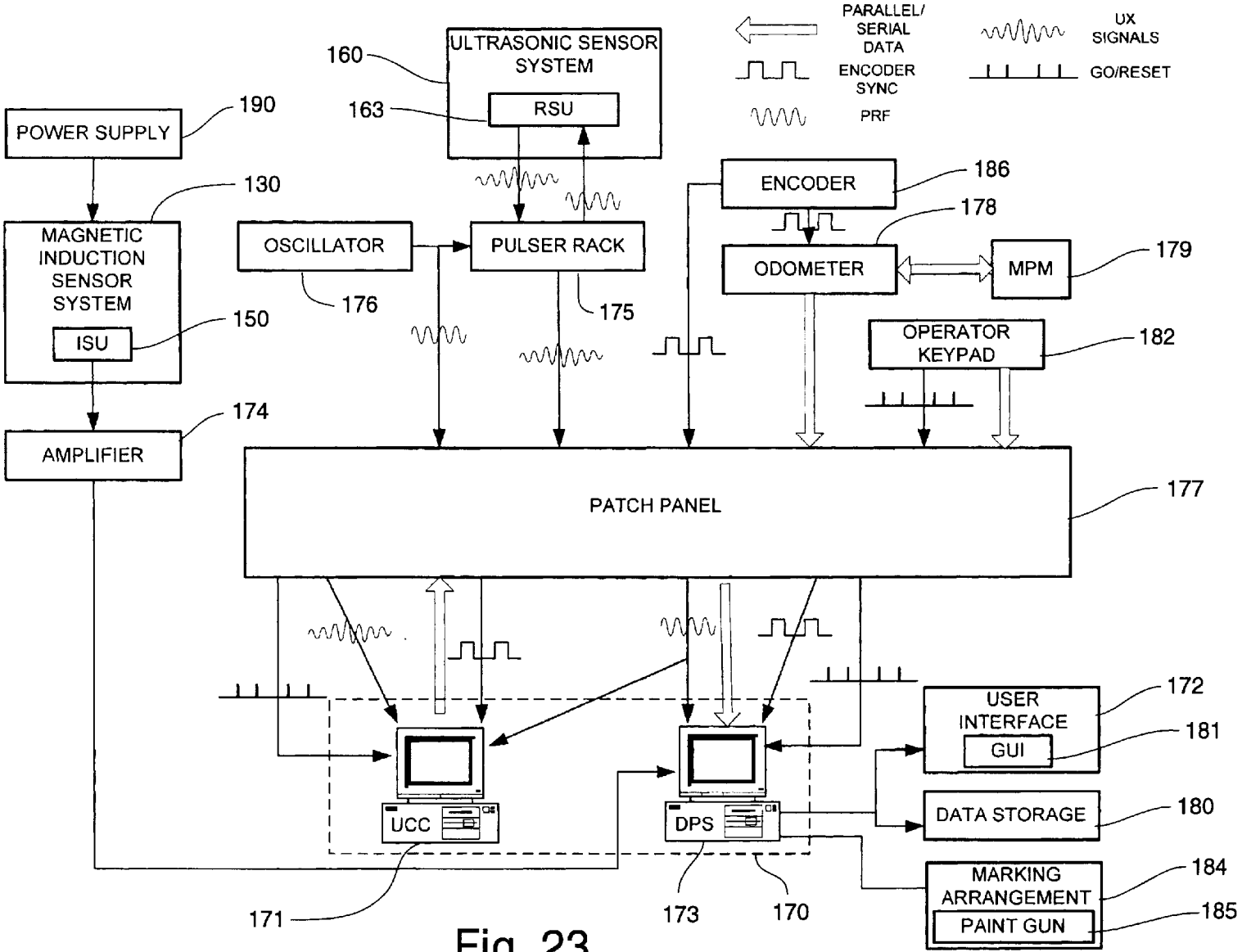
FIG. 23 is a block diagram of a data processing system of a rail inspection system according to an embodiment of the invention.

The data acquisition system (DAS) 106 of the rail inspection system 100 uses a personal computer-based data processing system 170 with advanced data processing software and hardware. A block diagram of the DAS 106 illustrating the flow of data through the system is shown in FIG. 23. The data processing system 170 uses two industrial grade computers, the ultrasonic control computer (UCC) 171 and the data processing and recording computer (DPS) 173 to process up to 32 channels of ultrasonic information and 16 channels of magnetic induction information. The computers are run by the Windows NT operating system and are networked so that information files can be shared.

In typical operation for an inspection system 100 having one ISU 150 per rail and two RSUs 163 per rail, the DAS 106 processes 24 channels of ultrasonic data (12 channels per rail) and 8 channels (4 channels per rail) of induction data. Raw ultrasonic data from the RSUs 163 is received and processed by the UCC 171, then passed to the DPS 173 via the patch panel 177. After passing through an amplifier 174, raw induction data from the ISUs 150 is passed directly to the DPS 173 where it is processed.

The system design provides spare input channels that may be used for additional ultrasonic or induction sensors or other sensors providing analog or digital data. This allows operation of the inspection system 100 to be customized to meet the needs of various rail testing requirements. The use of these spare channels is defined in the setup file.

Because they are not co-located on the carriage 110, the ISU 150 and RSUs 163 will pass a given location on the rail at different times. Accordingly, direct time synchronized data is insufficient for correlating defect information from the two sensor systems. The DAS 106 of the present invention therefore associates data with a synchronized location-based pulse. All data processed from both the induction and ultrasonic sensors are associated with an encoder synchronization pulse number generated by an encoder 186. The encoder 186 is a pulse generator coupled to a rail wheel 12 or associated axle of the vehicle 10 that pulses at a frequency proportional to the revolution frequency of the wheel 12. The encoder 186 produces a two phase square wave signal as a function of distance traveled. Each pulse so-generated is therefore associated with a specific location on the rail 2 over which the wheel 12 is rolling. The DAS 106 assigns a synchronization pulse number to each pulse and assures that this pulse number is properly associated with all sensor data obtained for the given location. As will be discussed, this allows data objects from the two types of sensor systems to be combined in assessing defects.

The encoder 186 is preferably coupled to an unbraked rail wheel 12 of the vehicle 10. It will be understood, however, that the encoder 186 could alternatively be coupled to one of the carriage wheels 122.

Signals from the ISUs 150 are provided in the form of a voltage that varies as a function of disruptions in the magnetic field caused by rail discontinuities. The voltage data is sampled on a per channel basis independent of detector carriage speed by a data acquisition card housed in the DPS 173. Digitized raw induction data is then passed to a DSP processor card also housed in the DPS 173. The DSP processor card first filters the raw induction data to remove noise. The filtered data is then resampled to provide the sensor's measured field value at each encoder sync pulse, which in turn provides a data stream at a fixed rate per unit distance. This data is then scaled to correct for vehicle speed and may also have other corrections applied to it as defined in the setup file. The filtered, scaled, resampled data is then made available for display and/or storage. The DSP processor card also takes this same filtered, scaled, resampled data stream and performs an envelope detection algorithm to determine the magnitude of the field strength at each encoder sync pulse. This envelope detection algorithm takes into account the unique nature of the bipolar signal generated by the ISU 150 and the fact that the ISU 150 behaves like a high pass filter. Once the envelope has been computed, a threshold is applied to create induction data objects according to rules dictated by the setup file. The DSP processor card calculates the RMS (root mean square) signal value over the span of the object. The induction data objects are described in terms of length, (RMS) amplitude and encoder pulse number. No depth information is included in the induction data objects. The induction data objects are then stored for display and, as will be discussed in more detail hereafter, are available to the DSP processor card for cross referencing against all other channels, including ultrasonic data objects that have arrived via a different data stream. The raw induction voltage data is also saved and may be displayed in spatial alignment with all other rail object data.

Ultrasonic (UX) signals are produced by the ultrasonic transducers in the RSUs 80. The ultrasonic transducers are excited by signals from a pulser rack 175 driven by an oscillator 176. The oscillator 176 produces a signal with a preset pulse repetition frequency (PRF) that the pulser rack 175 uses to trigger pulses to the transducers. The PRF is always greater than or equal to the frequency of the pulses generated by the encoder 186. This assures that the raw data acquisition frequency is greater than the rate at which the data is "sampled" within the DAS 106 for association with a synchronization pulse number. As long as this is the case, the sample resolution of the UX data may be made independent of the speed of the detector carriage 110.

The UX signals are passed through the pulser rack 175 to the UCC 171 receiver cards as raw, unfiltered analog signals. The UCC 171 includes receiver cards that amplify and filter these analog signals. The signals are then digitized so that they are represented by computer readable words made up of binary ones and zeros. The digitized signal is then analyzed based on time frames called "gates." The digital signals are then processed to produce a data set including channel number, amplitude and depth. A "lack of signal" may also be provided as configuration dictates. The data set is labeled for each PRF pulse number and an encoder sync pulse number.

The digitized information is assessed by the processing cards to determine whether a return is present during the gated period and whether that return is of an amplitude higher than a threshold voltage that is preset in the software. If the amplitude exceeds the threshold, the data set is transmitted to the DPS 173. The data from the UCC 171 are streamed from the individual receiver cards to a patch panel 177 via cabling. From the patch panel 177, the data streams are sent to the DPS 173 where an ultrasonic interface board (UIB) receives the data. The UIB reformats the data to add pulse number and milepost information. Milepost information is provided by an independent system called ODOMETER 178, which uses information from a mile post monitor (MPM) 179. The MPM 179 provides the current mileage location along the track and allows the operator to synchronize the mileage being reported to the DPS 173 to that of physical mileage markers along the track. Information related to other physical landmarks may also be entered to adjust the mileage location. The resulting ultrasonic data set is streamed to the DSP processor card which creates objects according to rules dictated in a setup file. An ultrasonic data object is described by it's length, amplitude, depth and pulse number. Start and end depth may also be saved, which allows the calculation of object angle and other characteristics.

It will be understood by those having ordinary skill in the art that the patch panel 177 is merely a convenient arrangement for interconnecting the various components of the DAS 106 and does not do any processing of the data. The patch panel 177 could, for example, be replaced by a series of direct connections between the components of the DAS 106.

Some information may be provided to the DAS 106 through an operator keypad 182. This information may include data such as an identification number for the track being inspected. The operator also may initiate a start/reset signal from the operator keypad 182. The start/reset signal has the effect of initializing or reinitializing the synchronization pulse number to zero, typically for the start of a new test run.

The DPS 173 thus produces and stores induction data objects and ultrasonic data objects. The DPS 173 also retains the raw induction data, although not in object form. The raw induction data is instead saved in record form, including all analog values for each pulse along with the pulse number. This allows the raw data to be spatially displayed with the induction and ultrasonic data objects.

The DPS 173 constructs a defect table that may be maintained in a setup file. The DPS 173 is configured to determine based on preset defect detection rules whether any of the objects from the ultrasonic and induction data channels should be marked as a suspected defect. The objects so-marked are referred to as system marked objects (SMOs). The SMOs are flagged in the final data stream by the DPS and made available to the user interface 172. The defect detection rules are independent of data object type and therefore treat ultrasonic and induction data objects alike. This allows defects to be defined as a combination of various object types. To further enhance defect determination, the defect processing allows AND, OR, and NOT type constructs to be defined as part of the defect definition.

The inspection system 100 may include a marking arrangement 184 to mark the location of the defect on the rail in response to the detection of a flaw by the detection sensors. This allows the location of the defect so that the defect can be verified with the use of manual instruments. This may be accomplished using one or more precision paint spray guns 185 mounted on the detector carriage 110 and electronically controlled by the DPS 173. When specific defect criteria are met, the DPS 173 provides a time critical signal that triggers the spray gun, which in turn paints the rail according to the signal it receives. By properly controlling the timing of the signal, the DPS 173 can cause the paint gun to mark the rail at the exact point of the suspected defect. The setup table in the DPS 173 may include offset parameters to allow painting to occur at the proper location based on information from for sensors located at differing locations on the detector carriage 110. Paint may be sprayed in various locations in order to assist in determining flaw location, not only along the rail, but also its location within the rail cross section.

All data objects and the raw induction data are available to the operator through the user interface 172 and may also be sent to a data storage device 180. The data storage device 180 may use any processor-readable medium for storage of the data but preferably uses a removable medium that can be easily removed and read by another processor. The data objects, with all SMOs flagged, are stored as B-Scan files that can be read offline using B-Scan software. The ultrasonic and induction object data is kept in its entirety. All analog data may be viewed when the system is operated in the on-line mode. Normally, only a limited amount of analog induction data is available for off-line use; specifically, the analog data in the areas adjoining the location of confirmed defects and operator selected rail data sections. Optionally, the system operator can elect to save all analog data prior to the start of a test. This facilitates full off-line analysis of track with unusual characteristics as well as a periodic review of the system operation.

An important aspect of the DAS 106 is the ability of the system to correlate data objects from different channels and, more importantly, different data types. This is accomplished through the determination and assignation of a pulse number to all data objects. The pulse number describes the position of the start of an object and thus can be used to spatially determine where an object occurred along the rail being examined. The object can thus be assembled with other objects occurring at the same spatial location. Offset parameters in the setup file in the DPS 173 allow the data from different sensors to be aligned independent of their physical position on the detector carriage 110. This is significant because the spatial location of the ISU 150 may differ from the location of an RSU 163 by several feet. The DPS 173 must also correct the spatial location of ultrasonic objects to account for sensor angle, the effect of which is to make objects deep in the rail appear to be further ahead or behind the location of the RSU 163 than they actually are.

Accordingly, induction and ultrasonic data objects may be cross referenced in any combination. This allows defect assessment based on criteria that uses both types of data. The DPS software includes algorithms that analyze the data from both sensor types in order to determine the presence of defects. These algorithms look at data amplitude, location in the rail, duration or length of the indication and the combination of signals from different channels and techniques. This allows the system to establish internal confirmation of defects detectable by both techniques.

In addition, association of all data with a pulse number allows all induction objects, ultrasonic data objects, and analog induction records to be spatially correlated for plotting on a graphical user interface (GUI) 181 as will be discussed in more detail hereafter.

The data processing system 170 can be used to assemble, correlate and present data from the detection units in real time. This allows the operator to view and confirm suspect defects on a B-scan display during data capture using the GUI 181. Data can also be buffered to allow the operator to perform B-scan analysis whenever the opportunity presents itself during a test run.

If there are more suspected defects than the operator has time to view during the run, analysis may be completed after the test has been ended. This allows the system to be used in a continuous, non-stop mode in addition to a stop-and-confirm mode. The system can also be used in conjunction with a chase car methodology wherein the location of a suspected defect is relayed to a second vehicle, which performs a detailed inspection of the suspect location.

Although not essential, a visual observation of the rails can supplement the displayed data. As a way of assisting the operator in making rapid decisions regarding the necessity of visual observation and the nature of identified defects, the DAS 106 may incorporate the use of artificial intelligence in the form of neural networks. These networks can be used as a way for the system to "learn" to identify defect types and assess their severity.

Graphical User Interface

The user interface 172 may include a GUI 181 developed to facilitate operation of test vehicles in stop-start, chase car and continuous inspection modes using both ultrasonic and magnetic induction test data. The DAS 106 can analyze the data in real time and provide the processed data to the GUI 181 in a rapid response form, to provide a detailed analysis of the data, or in an off-line mode to analyze previously captured data. This provides the capability of using the GUI 181 to compare data from different test runs for the same location, which can provide a time history of a defect.

Figure 24:
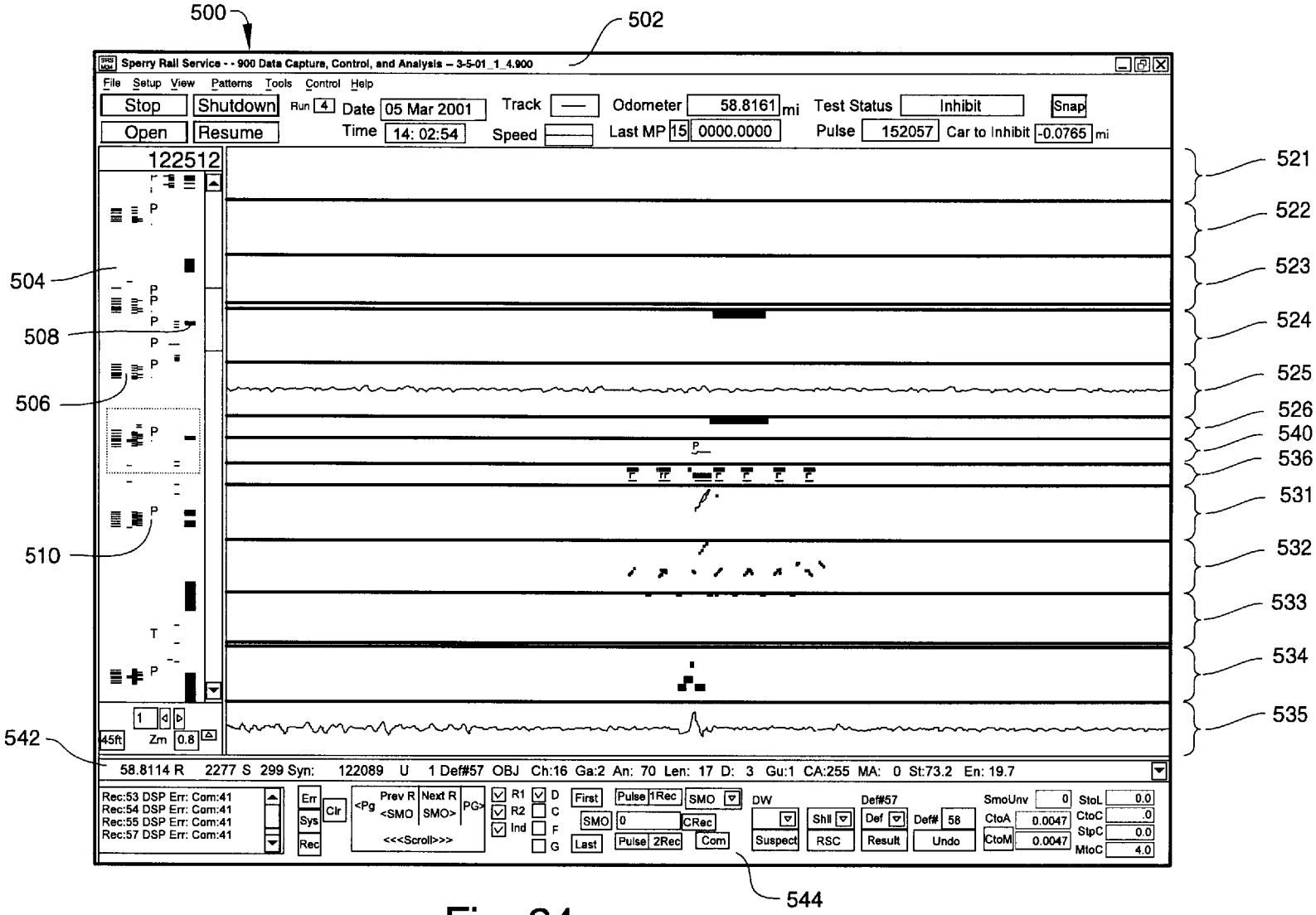
FIG. 24 is a screen shot illustrating a display of induction and ultrasonic data by a graphical user interface of a data processing system of a rail inspection system according to an embodiment of the invention.

The GUI 181 provides the operator with a variety of information along with visual representations of the induction and ultrasonic data objects and the raw induction data. FIG. 24 illustrates an exemplary screen display 500 as displayed on the GUI 181. The display 500 includes a location and status bar 502 across the top of the screen. The location and status bar 502 provides the operator with system information including test date, time, the track being inspected, the current car speed and odometer reading, the mileage of the last milepost passed, the type of test and the pulse count from the start of the test run.

Sensor data is displayed in two main windows: a strip chart window 504 and a main display window 514. The strip chart window 504 is a vertically oriented window positioned at the left of the screen. The strip chart window 504 includes a condensed B-scan display that shows the location along the track of all identified objects and acts as a guide to help the operator remain oriented on the track when he is viewing the data. Left rail information is shown in the left-hand portion 506 of the strip chart window 504. Right rail information is shown in the right-hand portion 508 of the strip chart window 504. The center column 510 is provided for display of comment codes such as notation of locations that have been marked as possible defects. A highlight box 512 shows the area being displayed in the main display window 514. The strip chart display can be zoomed at increments of 10%.

The main display window 514 consists of a default set of B-Scan display areas and induction display areas for both rails. Each rail display is identical and can be resized in order to maintain the best scale. The arrangement of the data display can be established in a set up file. As shown, sensor data may be displayed in five subwindows 521–525 at the top of the main display window 514 for the left rail and five subwindows 531–535 at the bottom of the main display window for the right rail. Three B-Scan subwindows 521–523, 531–533 for each rail are provided for B-Scan display of ultrasonic data objects. Each of these B-Scan subwindows 521–523, 531–533 may be set to selectively display information from a different ultrasonic probe angle.

Two subwindows 524, 525, 534, 535 for each rail are provided for display of induction data. Subwindows 524 and 534 illustrate induction data objects while subwindows 525 and 535 display raw analog induction data. Induction data objects for multiple channels may be displayed in subwindows 524 and 534. Each channel may be represented by a different color and may be placed in its own vertical position represented by a horizontal baseline reference. The subwindows 524 and 535 may be scaled according to the number of channels being displayed. The analog induction display subwindows may be used to display data from any or all of the induction data channels. When multiple channels are displayed, each channel may be assigned a different color.

Left rail and right rail SMO subwindows 526, 536 are provided near the center of the main display window 514. The SMO subwindows 526, 536 provide a display of all SMOs identified for the left rail and the right rail respectively, regardless of data type. Each SMO is centered on the display with a small marker displayed beneath it to denote its exact position. A user can scroll to either side of the defect using a scroll button. In between the SMO subwindows 526, 536 is a comment subwindow 540 that displays symbols relating to the associated pulse number.

In general, information from different channels or in different windows may be displayed using different colors. Data objects having amplitudes above a specified amplitude may be displayed in a "hot" color that is unique from any other channel color.

The induction data display subwindows 524, 525, 534, 535 may be switched off when induction testing is not required, in which case the B-Scan display windows can be increased in size.

An operator may select a particular location record for display of additional information. This information is displayed in an active record display 542 that shows information specific to the record highlighted by the operator. This information may include, for example, the mileage location, the record number and a suspect number if the record contains a suspected defect.

An options and navigation toolbar 544 is provided at the bottom of the display for use by the operator in controlling the display of information on the GUI 181.

SUMMARY

The detector system 104, including the detector carriage 110 and its sensors, the power supply system 102 and the data processing system 106 of the rail inspection system 100 provide a platform for obtaining both ultrasonic and magnetic induction test data using a vehicle that is not confined to rail travel. Railroads will be able to use this platform to reap the benefits of complementary ultrasonic and induction rail inspection data without incurring the traffic delays and expense associated with the use of rail-bound test vehicles.

The various systems and assemblies of the rail inspection system 100 may also be used as part of other inspection systems and, in particular may be used with inspection systems used in conjunction with railbound vehicles. The data acquisition system 106 may be used for any inspection system having ultrasonic sensors, magnetic induction sensors or both. The power supply system 102 may be used in any inspection system having magnetic induction sensors. The detector system 104 may be used in conjunction with any vehicle capable of propelling the detector carriage 110 along the rails. The solid state brush assembly 140 and its components have wide application beyond their use in a lightweight detector carriage.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A railroad rail inspection system for use in conjunction with a non-railbound vehicle having an equipment bay, the system comprising:

a detector carriage adapted for being propelled over a two-rail railroad track by the non-railbound vehicle;

a magnetic induction sensor system attached to the detector carriage, the magnetic inductor sensor system being adapted for magnetic induction inspection of at least one rail of the track;

a data acquisition system in communication with the magnetic induction sensor system, the data acquisition system including at least one data processor adapted for processing induction data received from the magnetic induction sensor system; and a power supply system in electrical communication with the magnetic induction sensor system, the power supply system being adapted for supplying electrical power to the magnetic induction sensor system;

wherein the data acquisition system and the power supply system are configured for disposition and operation within the equipment bay of the non-railbound vehicle.

2. A rail inspection system according to claim 1 wherein the non-railbound vehicle is a hi-rail vehicle adapted for use in both highway travel and travel over the two-rail railroad track.

3. A rail inspection system according to claim 1 wherein the magnetic induction sensor system includes at least one brush assembly in electrical communication with the power supply system, the at least one brush assembly being configured for selectively engaging the at least one rail and for selectively conducting electrical current into the at least one rail to saturate a test portion of the at least one rail and establish a magnetic field around the at least one rail; and an induction search unit in communication with the data acquisition system, the induction search unit being configured for sensing perturbations in the magnetic field around the test portion of the at least one rail.

4. A rail inspection system according to claim 3 wherein the magnetic induction system includes first and second brush assemblies in communication with the power supply system, the first and second brush assemblies being adapted for selectively engaging the upper surface of the at least one rail to establish electrical communication therewith, the first and second brush assemblies being positioned in tandem alignment in a spaced apart relationship so that engagement by the first and second brush assemblies with the rail establishes a rail saturation circuit from the power supply system through the first brush assembly, the test portion of the at least one rail, the second brush assembly and back to the power supply system.

5. A rail inspection system according to claim 4 wherein the first and second brush assemblies each comprise:

a bus block in electrical communication with the power supply system;

a bristle holder attached to and in electrical communication with the bus block; and a plurality of elongate bristle assemblies in electrical communication with the bristle holder, each bristle assembly having a plurality of elongate wire elements each having a proximal end and a distal end configured for contacting the upper surface of the rail, the proximal ends of the plurality of wire elements being collectively secured by a sleeve-like cap;

wherein the bristle holder is adapted for receiving the bristle assemblies and securing the bristle assemblies in place at an angled orientation.

6. A rail inspection system according to claim 5 wherein the elongate wire elements are formed from a beryllium copper alloy.

7. A rail inspection system according to claim 3 wherein the magnetic induction sensor system includes a first at least one brush assembly in electrical communication with the power supply system and configured for selectively engaging a first rail and for selectively conducting electrical current into the first rail to saturate a first rail test portion and establish a first magnetic field around the first rail;

a first induction search unit in communication with the data acquisition system, the first induction search unit being configured for sensing perturbations in the first magnetic field;

a second at least one brush assembly in electrical communication with the power supply system and configured for selectively engaging a second rail and for selectively conducting electrical current into the second rail to saturate a second rail test portion and establish a second magnetic field around the second rail; and a second induction search unit in communication with the data acquisition system, the second induction search unit being configured for sensing perturbations in the second magnetic field.

8. A rail inspection system according to claim 7 wherein the magnetic induction sensor system includes first and second brush assemblies in communication with the power supply system, the first and second brush assemblies being adapted for selectively engaging the upper surface of the first rail to establish electrical communication therewith, the first and second brush assemblies being positioned in tandem alignment in a spaced apart relationship; and third and fourth brush assemblies in communication with the power supply system, the third and fourth brush assemblies being adapted for selectively engaging the upper surface of the second rail to establish electrical communication therewith, the third and fourth brush assemblies being positioned in tandem alignment in a spaced apart relationship, wherein engagement by the first and second brush assemblies with the first rail and engagement by the third and fourth brush assemblies with the second rail completes a rail saturation circuit from the power supply system through the first brush assembly, the first rail test portion, the second brush assembly, the third brush assembly, the second rail test portion, the fourth brush assembly and back to the power supply system.

9. A rail inspection system according to claim 8 wherein the first, second, third and fourth brush assemblies each comprise:

a bus block in electrical communication with the power supply system;

a bristle holder attached to and in electrical communication with the bus block; and a plurality of elongate bristle assemblies in electrical communication with the bristle holder, each bristle assembly having a plurality of elongate wire elements each having a proximal end and a distal end configured for contacting the upper surface of the rail, the proximal ends of the plurality of wire elements being collectively secured by a sleeve-like cap;

wherein the bristle holder is adapted for receiving the bristle assemblies and securing the bristle assemblies in place at an angled orientation.

10. A rail inspection system according to claim 3 wherein the induction search unit includes a plurality of inductive coils disposed in a coil housing, each inductive coil being in electrical communication with the data acquisition system.

11. A rail inspection system according to claim 1 further comprising an ultrasonic sensor system attached to the detector carriage, the ultrasonic sensor system being adapted for ultrasonic inspection of the at least one rail of the track.

12. A rail inspection system according to claim 11 wherein the ultrasonic sensor system includes at least one roller search unit comprising a fluid-filled wheel adapted for engaging the upper surface of the at least one rail, the fluid-filled wheel having disposed therein an array of ultrasonic sensors adapted for transmission and reception of ultrasonic beams into and from the at least one rail for detection of defects within the rail, the array of ultrasonic sensors being in communication with the data acquisition system.

13. A rail inspection system according to claim 12 wherein the ultrasonic sensor system includes a plurality of roller search units with at least a first one of the roller search units adapted for ultrasonic inspection of a first rail and at least a second one of the roller search units being adapted for ultrasonic inspection of a second rail.

14. A rail inspection system according to claim 11 wherein the at least one data processor is adapted for processing ultrasonic signal data received from the ultrasonic sensor system.

15. A rail inspection system according to claim 14 wherein the at least one data processor is adapted for correlating and integrating the ultrasonic signal data with the induction data.

16. A rail inspection system according to claim 15 further comprising a graphical user interface in communication with the at least one automatic data processor, the graphical user interface being adapted for visual presentation of the correlated and integrated ultrasonic signal data and the induction data.

17. A rail inspection system according to claim 1 wherein the power supply system comprises a generator powered by an internal combustion engine; and at least one power supply in electrical communication with the generator and having a plurality of switching power supply modules connected in parallel.

18. A rail inspection system according to claim 1 wherein the at least one power supply has an output capacity of at least 3600 amps DC at a voltage in a range of about 0.5 volts to about 3.5 volts.

19. A rail inspection system according to claim 1 further comprising a carriage stowing arrangement adapted for attachment to the non-railbound vehicle, the stowing arrangement including:

a stowing frame adapted for pivotal attachment to a portion of the non-railbound vehicle, for selective extension outward from the railbound vehicle in a carriage attachment position, and for selective retraction to a stowed position adjacent a surface of the non-railbound vehicle;

means for removably attaching the stowing frame to the detector carriage; and means for pivotably moving the stowing frame between the carriage attachment position and the stowed position.

20. A rail inspection system according to claim 1 wherein the means for performing magnetic induction inspection includes brush means for selectively conducting electrical current into the at least one rail to saturate a test portion of the at least one rail and establish a magnetic field around the at least one rail, the means for selectively conducting being in electrical communication with the means for supplying electrical power; and induction sensor means for sensing perturbations in the magnetic field around the test portion of the at least one rail, the induction sensor means being in communication with the means for processing induction data.

21. A rail inspection system according to claim 20 wherein the means for performing magnetic induction inspection includes first and second brush assemblies in communication with the means for supplying electrical power, the first and second brush assemblies being adapted for selectively engaging the upper surface of the at least one rail to establish electrical communication therewith, the first and second brush assemblies being positioned in tandem alignment in a spaced apart relationship so that engagement by the first and second brush assemblies with the rail establishes a rail saturation circuit from the means for supplying electrical power through the first brush assembly, the test portion of the at least one rail, the second brush assembly and back to the means for supplying electrical power.

22. A railroad rail inspection system for use in conjunction with a non-railbound vehicle having an equipment bay, the system comprising:

a detector carriage adapted for being propelled over a two-rail railroad track by the non-railbound vehicle;

means for performing magnetic induction inspection of at least one rail of the track, the means for performing magnetic induction inspection being attached to the detector carriage;

means for processing induction data received from the means for performing magnetic induction inspection; and means for supplying electrical power to the means for performing magnetic induction inspection, the means for supplying electrical power including means for generating power sufficient to establish a magnetic field around the rail for use by the means for performing magnetic induction inspection;

wherein the means for processing induction data and the means for supplying electrical power are configured for disposition and operation within the equipment bay of the non-railbound vehicle.

23. A rail inspection system according to claim 22 wherein the non-railbound vehicle is a hi-rail vehicle adapted for use in both highway travel and travel over the two-rail railroad track.

24. A rail inspection system according to claim 22 further comprising means for performing ultrasonic inspection of the at least one rail of the track, the means for performing ultrasonic inspection being attached to the detector carriage and means for processing ultrasonic data received from the means for performing ultrasonic inspection.

25. A rail inspection system according to claim 24 wherein the means for performing ultrasonic inspection includes at least one roller search unit comprising a fluid-filled wheel adapted for engaging the upper surface of the at least one rail, the fluid-filled wheel having disposed therein an array of ultrasonic sensors adapted for transmission and reception of ultrasonic beams into and from the at least one rail for detection of defects within the rail, the array of ultrasonic sensors being in communication with the means for processing ultrasonic data.

26. A rail inspection system according to claim 25 further comprising means for correlating and integrating the ultrasonic data with the induction data, the means for correlating and integrating being in communication with the means for processing induction data and the means for processing ultrasonic data.

27. A rail inspection system according to claim 22 wherein the means for supplying electrical power comprises:

a generator powered by an internal combustion engine; and at least one power supply in electrical communication with the generator and having a plurality of switching power supply modules connected in parallel.

28. A rail inspection system according to claim 22 further comprising means for stowing the detector carriage onboard the non-railbound vehicle, the means for stowing being adapted for attachment to the non-railbound vehicle and including:

a stowing frame adapted for pivotal attachment to a portion of the non-railbound vehicle, for selective extension outward from the railbound vehicle in a carriage attachment position, and for selective retraction to a stowed position adjacent a surface of the non-railbound vehicle;

means for removably attaching the stowing frame to the detector carriage; and means for pivotably moving the stowing frame between the carriage attachment position and the stowed position.

29. A method of performing magnetic induction inspection of a two-rail railroad track using a non-railbound vehicle having an equipment bay, the method comprising:

providing a detector carriage adapted for being propelled over the two-rail railroad track by the non-railbound vehicle, the detector carriage having attached thereto a magnetic induction sensor system adapted for magnetic induction inspection of at least one rail of the track;

installing in the equipment bay of the non-railbound vehicle a data acquisition system in communication with the magnetic induction sensor system, the data acquisition system including at least one data processor adapted for processing induction data received from the magnetic induction sensor system; and installing in the equipment bay of the non-railbound vehicle a power supply system in electrical communication with the magnetic induction sensor system, the power supply system being adapted for supplying power to the magnetic induction sensor system for application of a saturating current to the at least one rail of the track;

propelling the detector carriage along a two rail railroad track using the non-railbound vehicle; and obtaining magnetic induction data for the at least one rail of the track using the magnetic induction sensor system.

30. A method according to claim 29 further comprising:

receiving the magnetic induction data at the data processor; and processing the magnetic induction data using the at least one data processor.

* * * * *